US012637826B2

(12) United States Patent
Hatta

(10) Patent No.: US 12,637,826 B2
(45) Date of Patent: May 26, 2026

(54) WORKING MACHINE

(71) Applicant: KUBOTA CORPORATION, Osaka (JP)

(72) Inventor: Kazuyuki Hatta, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 264 days.

(21) Appl. No.: 18/536,840

(22) Filed: Dec. 12, 2023

(65) Prior Publication Data

US 2024/0110358 A1 Apr. 4, 2024

Related U.S. Application Data

(63) Continuation of application No. PCT/JP2022/014329, filed on Mar. 25, 2022.

(30) Foreign Application Priority Data

Jun. 29, 2021 (JP) ..... 2021-107839

(51) Int. Cl.

| | |
|---|---|
| ***E02F 3/32*** | (2006.01) |
| ***E02F 3/38*** | (2006.01) |
| *E02F 3/96* | (2006.01) |
| *E02F 9/16* | (2006.01) |
| *E02F 9/22* | (2006.01) |

(52) U.S. Cl.

CPC ..... *E02F 3/32* (2013.01); *E02F 3/38* (2013.01); *E02F 3/964* (2013.01); *E02F 9/16* (2013.01); *E02F 9/2203* (2013.01); *E02F 9/2278* (2013.01)

(58) Field of Classification Search

None

See application file for complete search history.

(56) References Cited

U.S. PATENT DOCUMENTS 4,728,251 A 3/1988 Takashima et al.
2019/0010966 A1* 1/2019 Bellows ..... E02F 9/2203

(Continued)

FOREIGN PATENT DOCUMENTS

JP 54-015403 U1 1/1979
JP H 08-269996 A 10/1996

(Continued)

OTHER PUBLICATIONS

Extended European Search Report, dated May 27, 2025, issued in EUROPEAN family member (EPO) Patent Application No. 22832507.2.

(Continued)

*Primary Examiner* — Michael S Lowe

(74) *Attorney, Agent, or Firm* — GREENBLUM & BERNSTEIN, P.L.C.

(57) ABSTRACT

A boom is configured such that, when the boom is in its fully raised position, a first section between an intermediate portion and a boom proximal portion extends upward from the boom proximal portion toward the intermediate portion and a second section between the intermediate portion and a boom distal portion extends diagonally forward and upward from the intermediate portion, and that a first straight line orthogonal to an arm support shaft and to a first cylinder support shaft and extending downward from the first cylinder support shaft passes forward of a machine body.

11 Claims, 13 Drawing Sheets

(56) References Cited

U.S. PATENT DOCUMENTS

| | | | |
|---|---|---|---|
| 2020/0354920 | A1 | 11/2020 | Horii et al. |
| 2020/0407944 | A1 | 12/2020 | Boyd et al. |
| 2021/0404144 | A1 | 12/2021 | Hatta et al. |

FOREIGN PATENT DOCUMENTS

| | | | |
|---|---|---|---|
| JP | 2014-214537 | A | 11/2014 |
| JP | 2019-127725 | A | 8/2019 |
| JP | 2020-148070 | A | 9/2020 |
| JP | 2021-008741 | A | 1/2021 |

OTHER PUBLICATIONS

International Search Report dated Jun. 14, 2022 in International application No. PCT/JP2022/014329 with English language translation thereof.
Written Opinion dated Jun. 14, 2022 in International application No. PCT/JP2022/014329 with English language translation thereof.

* cited by examiner

WORKING MACHINE

CROSS REFERENCE TO RELATED APPLICATIONS

This application is a continuation application of International Application No. PCT/JP2022/014329, filed on Mar. 25, 2022, which claims the benefit of priority to Japanese Patent Application No. 2021-107839, filed on Jun. 29, 2021. The entire contents of each of these applications are hereby incorporated herein by reference.

BACKGROUND OF THE INVENTION

1. Field of the Invention

The present invention relates to a working machine.

2. Description of the Related Art

A working machine disclosed in Japanese Unexamined Patent Application Publication No. 2020-148070 has been known.

The working machine disclosed in Japanese Unexamined Patent Application Publication No. 2020-148070 includes a boom that is supported swingably upward and downward by a boom support provided forward of a machine body. The boom includes a boom proximal portion that is pivotally supported by the boom support, a boom distal portion by which an arm is pivotally supported, and a boom body portion that is a portion between the boom proximal portion and the boom distal portion and that is bent at an intermediate portion in a boom longitudinal direction. The boom body portion includes a first section between the intermediate portion and the boom proximal portion and a second section between the intermediate portion and the distal end portion.

When the boom is in a fully raised position in which the boom is fully swung upward, the boom is in an orientation in which the first section extends upward from the boom proximal portion and in which the second section extends such that the second section is inclined forward with increasing distance from an intermediate portion upward.

SUMMARY OF THE INVENTION

There is a demand to increase the height of a boom distal portion when a boom is in a fully raised position. There is also a demand to reduce the weight of a boom.

Example embodiments of the present invention provide working machines in each of which the height of a boom distal portion when a boom is in a fully raised position can be increased and in each of which the weight of the boom can be reduced.

A working machine according to an aspect of an example embodiment of the present invention includes a machine body, a boom support located forward of the machine body, a boom to swing upward and downward about a boom support shaft, the boom including a boom proximal portion pivotally supported on the boom support via the boom support shaft, a boom distal portion to pivotally support an arm via an arm support shaft such that the arm is swingable, and a boom body portion bent at an intermediate portion in a longitudinal direction of the boom, the boom body portion being a portion between the boom proximal portion and the boom distal portion, and a boom cylinder to extend and retract to cause the boom to swing, the boom cylinder being located on a front side of the boom and including a first end pivotally supported on a front side of the boom body portion via a first cylinder support shaft and a second end pivotally supported on the boom support via a second cylinder support shaft, wherein the boom is configured such that, when the boom is in a fully raised position thereof, a first section between the intermediate portion and the boom proximal portion extends upward from the boom proximal portion toward the intermediate portion and a second section between the intermediate portion and the boom distal portion extends diagonally forward and upward from the intermediate portion, and that a first straight line orthogonal to the arm support shaft and to the first cylinder support shaft and extending downward from the first cylinder support shaft passes forward of the machine body.

The working machine may further include an operator's seat mounted on the machine body. The boom may be configured such that a first extension line extending downward from a back surface of the second section passes forward of the operator's seat, the first extension line being an extension of the back surface of the second section when the boom is in the fully raised position.

The working machine may further include an operator's seat mounted on the machine body. The boom may be configured such that a second extension line extending downward from a front surface of the second section passes forward of the operator's seat, the second extension line being an extension of the front surface of the second section when the boom is in the fully raised position.

When the boom is in the fully raised position, a first distance between a first intersection and a second intersection may be smaller than a second distance between the second intersection and a third intersection, where the first intersection is an intersection of a second straight line and a third straight line, the second intersection is an intersection of the third straight line and a front surface of the boom body portion, the third intersection is an intersection of the third straight line and a back surface of the boom body portion, the second straight line is a straight line orthogonal to the arm support shaft and to the boom support shaft, and the third straight line is a straight line orthogonal to the second straight line and to the first cylinder support shaft.

When the boom is in the fully raised position, a fifth distance between a fifth intersection and a sixth intersection may be smaller than a sixth distance between an axis of the arm support shaft and the fifth intersection, where the fifth intersection is an intersection of a fourth straight line and a fifth straight line, the sixth intersection is an intersection of the fifth straight line and a back surface of the boom body portion, the fourth straight line is a vertical line orthogonal to the arm support shaft, and the fifth straight line is a straight line orthogonal to the fourth straight line and to the first cylinder support shaft.

When the boom is in the fully raised position, a seventh distance between the fourth straight line and a seventh straight line may be smaller than an eighth distance between a sixth straight line and the seventh straight line, where the sixth straight line is a vertical line orthogonal to the boom support shaft and the seventh straight line is a vertical line orthogonal to the second cylinder support shaft.

The sixth distance may be larger than a ninth distance which is a vertical distance between the fifth straight line and an upper edge of a side surface of the boom proximal portion.

The boom proximal portion may include a pivotal support section pivotally supported via the boom support shaft and a connected section connected to the first section of the boom body portion. The boom proximal portion may be bent at a location between the pivotal support section and the connected section such that, when the boom is in the fully raised position, the pivotal support section extends in a diagonally rearward and upward direction from the boom support shaft and the connected section extends upward from the pivotal support section.

A first bend angle between a front surface of the first section and a front surface of the second section may be larger than a second bend angle between a front surface of the pivotal support section and a front surface of the connected section.

The working machine may further include a working tool pivotally supported on the arm via a working tool support shaft to swing about the working tool support shaft between a working-tool crowd position and a working-tool dump position, the working-tool crowd position being a position in in which a distal end portion of the working tool is closest to the arm, the working-tool dump position being a position in which the distal end portion of the working tool is most distant from the arm, an arm cylinder to cause the arm to swing in an arm crowd direction toward the boom and an arm dump direction away from the boom, and an arm crowd restrictor to limit a stroke of the arm cylinder in a direction that causes the arm to move in the arm crowd direction such that a swing path of the distal end portion of the working tool and the boom cylinder are separated from each other by a predetermined distance or more.

The working machine may further include a working tool pivotally supported on the arm via a working tool support shaft to swing about the working tool support shaft between a working-tool crowd position and a working-tool dump position, the working-tool crowd position being a position in which a distal end portion of the working tool is closest to the arm, the working-tool dump position being a position in which the distal end portion of the working tool is most distant from the arm, a working tool cylinder to cause the working tool to swing in a working-tool crowd direction and a working-tool dump direction, the working-tool crowd direction being a direction in which the distal end portion of the working tool approaches the working-tool crowd position, the working-tool dump direction being a direction in which the distal end portion of the working tool approaches the working-tool dump position, and a working-tool crowd restrictor to limit a stroke of the working tool cylinder in a direction that causes the working tool to move in the working-tool crowd direction such that a swing path of the distal end portion of the working tool and the boom cylinder are separated from each other by a predetermined distance or more.

The above and other elements, features, steps, characteristics and advantages of the present invention will become more apparent from the following detailed description of the example embodiments with reference to the attached drawings.

BRIEF DESCRIPTION OF THE DRAWINGS

A more complete appreciation of example embodiments of the present invention and many of the attendant advantages thereof will be readily obtained as the same becomes better understood by reference to the following detailed description when considered in connection with the accompanying drawings described below.

DETAILED DESCRIPTION OF THE EXAMPLE EMBODIMENTS

Figure 1:
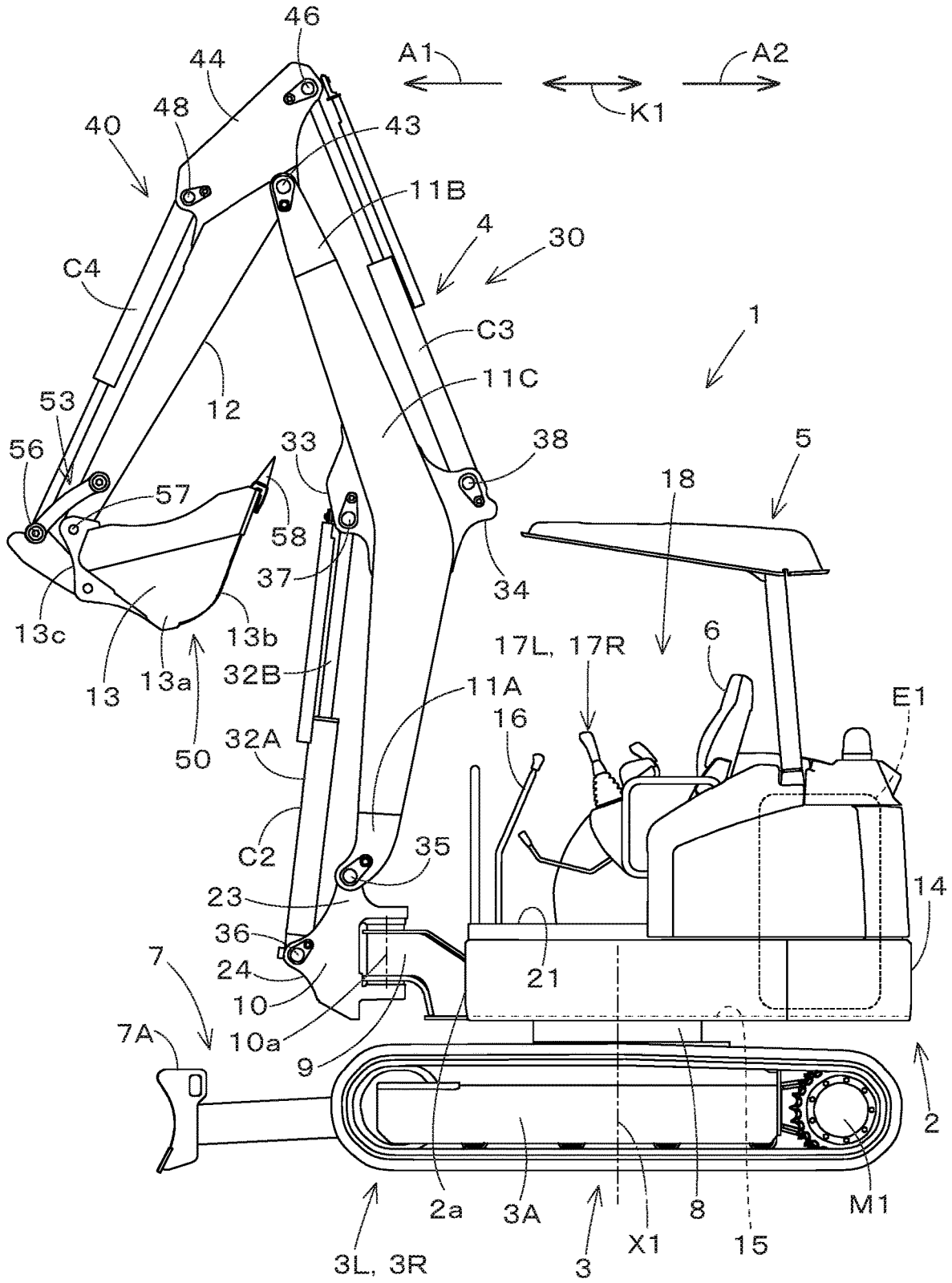
FIG. 1 is a side view of a working machine.

The example embodiments will now be described with reference to the accompanying drawings, wherein like reference numerals designate corresponding or identical elements throughout the various drawings. The drawings are to be viewed in an orientation in which the reference numerals are viewed correctly.

Hereinafter, embodiments of the present invention will be described with the drawings being referred, as appropriate.

FIG. 1 is a schematic side view illustrating an overall configuration of a working machine 1 according to the present embodiment. In the present embodiment, a backhoe, which is a swiveling work machine, is presented as an example of the working machine 1.

As illustrated in FIG. 1, the working machine 1 includes a machine body (swivel base) 2, a traveling device 3, and a working device 4. An operator's seat 6 on which an operator (driver) is to sit is mounted on the machine body 2. A canopy 5 is mounted on the machine body 2. The canopy 5 is an operator's seat protection device that protects the operator's seat 6. As an alternative to the canopy 5, a cabin that surrounds the operator's seat 6 may be mounted as an operator's seat protection device.

In the present embodiment, a direction (the arrow A1 direction in FIG. 1) toward the front side of an operator sitting on the operator's seat 6 of the working machine 1 will be described as forward (forward of the machine body), a direction (the arrow A2 direction in FIG. 1) toward the rear side of the operator will be described as rearward (rearward of the machine body), and the arrow K1 direction in FIG. 1 will be described as the front-rear direction (front-rear direction of the machine body). A direction (near side in FIG. 1) toward the left side of the operator will be described as leftward and a direction (far side in FIG. 1) toward the right side of the operator will be described as rightward.

A horizontal direction, which is a direction orthogonal to the front-rear direction K1, will be described as the machine-body width direction. A direction from a central portion in the width direction of the machine body 2 toward a right portion or a left portion will be described as outward in the machine-body width direction. That is, outward in the machine-body width direction is a direction away from the center in the width direction of the machine body 2 in the machine-body width direction. An opposite direction of outward in the machine-body width direction will be described as inward in the machine-body width direction. That is, inward in the machine-body width direction is a direction toward the center in the width direction of the machine body 2 in the machine-body width direction.

As illustrated in FIG. 1, the traveling device 3, which is a crawler-type traveling device that supports the machine body 2 so as to be able to travel, includes a travel frame 3A, a first traveling device 3L provided on the left side of the travel frame 3A, and a second traveling device 3R provided on the right side of the travel frame 3A. The first traveling device 3L and the second traveling device 3R are driven by a traveling motor M1 constituted by a hydraulic motor (hydraulic actuator). While the traveling device 3 of a crawler type is used in the present embodiment, this does not imply any limitation, and a traveling device of a wheel type or the like may be used.

A dozer device 7 is mounted on a front portion of the traveling device 3. The dozer device 7 can lift and lower (raise and lower) a blade (excavator plate) 7A by extending and retracting a dozer cylinder (hydraulic actuator), which is not illustrated.

As illustrated in FIG. 1, the machine body 2 includes a swiveling base 15 that swivels about a swiveling axis X1, which is an axis extending in the up-down direction. The swiveling base 15 is formed of a steel sheet and the like and constitutes a bottom portion of the machine body 2. A weight 14 is provided at a rear portion of the machine body 2. The machine body 2 (swiveling base 15) is supported above the traveling device 3 via a swivel bearing 8 so as to be able to swivel about the swiveling axis X1.

As illustrated in FIG. 1, the working machine 1 includes a support bracket 9 and a swing bracket (boom support) 10. The support bracket 9 is provided so as to protrude forward from the machine body 2. That is, the support bracket 9 protrudes forward from a front surface 2*a* of the machine body 2. The swing bracket 10 is a member that supports the working device 4 and is provided forward of the machine body 2. Specifically, the swing bracket 10 is attached to a front portion of the support bracket 9 so as to be able to swing about a swing axis 10*a* extending in the up-down direction. Therefore, the swing bracket 10 is able to turn in the machine-body width direction (in the horizontal direction about the swing axis 10*a*). The swing bracket 10 is able to swing by extension and retraction of a swing cylinder (hydraulic actuator), which is not illustrated.

As illustrated in FIG. 1, a prime mover E1 is mounted at a rear portion of the machine body 2. Specifically, the prime mover E1 is mounted on the swiveling base 15. The prime mover E1 is a diesel engine. Note that the prime mover E1 may be a gasoline engine or an electric motor and may be of a hybrid type including an engine and an electric motor. An operation unit 18 that includes the operator's seat 6, a traveling lever 16 located forward of the operator's seat 6, a manipulation device 17L located on the left side of the operator's seat 6, a manipulation device 17R located on the right side of the operator's seat 6, and the like is mounted on the forward side of the prime mover E1 of the machine body 2. The traveling lever 16 is an operation member that operates the traveling device 3. The manipulation devices 17L and 17R are devices that perform, for example, an operation (a swinging operation of a boom 11, a swinging operation of an arm 12, or a swinging operation of a bucket 13) of the working device 4, a swiveling operation of the machine body 2, and the like. A step 21 constituting a floor surface is provided on the upper surface side of the machine body 2 and on the forward side of the operator's seat 6.

Figure 2:
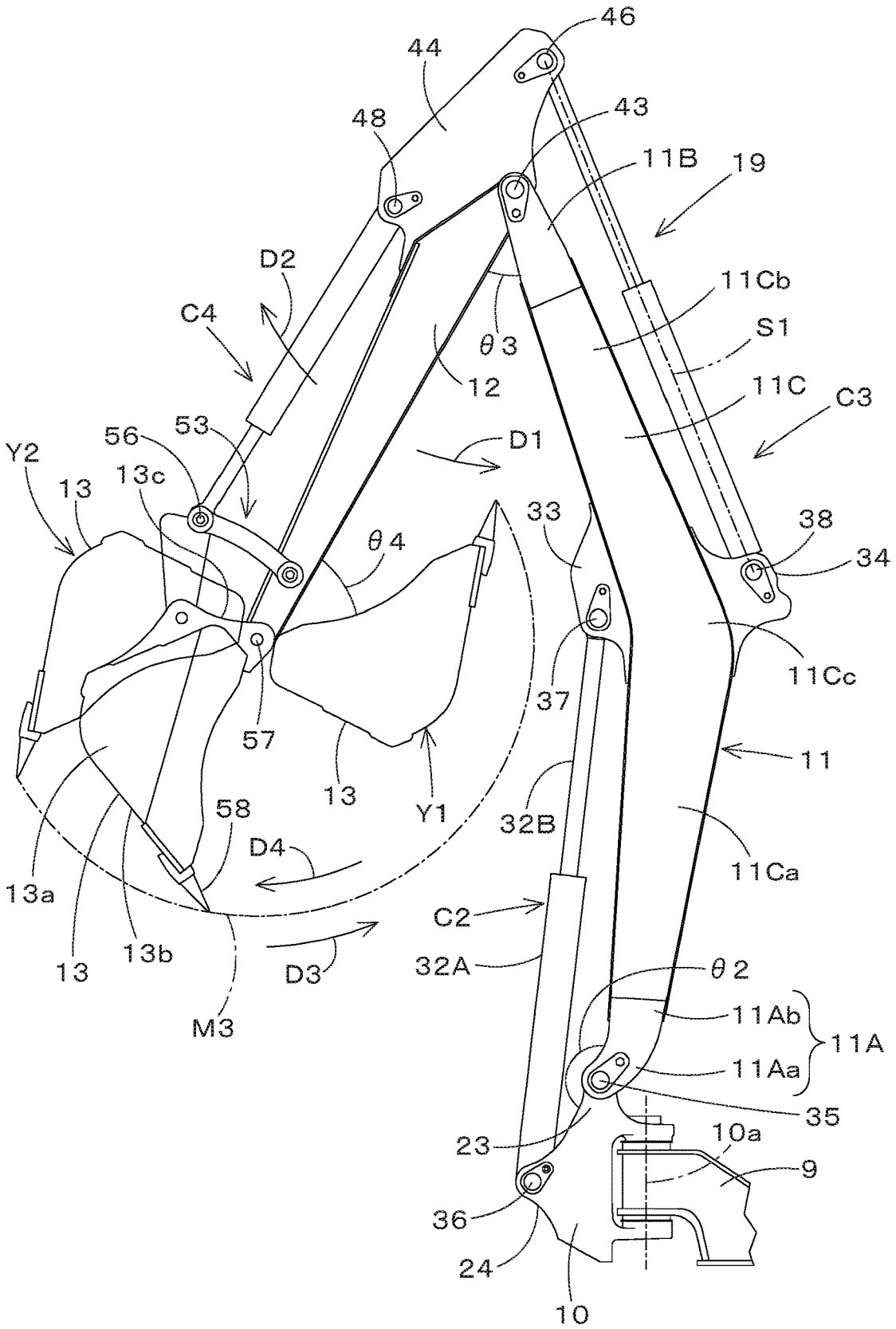
FIG. 2 is a side view of a working device.

As illustrated in FIGS. 1 and 2, the working device 4 includes a boom device 30, an arm device 40, and a working tool device 50. The boom device 30 includes the boom 11 and a boom cylinder C2. The arm device 40 includes the arm 12 and an arm cylinder C3. The working tool device 50 includes the bucket 13 as a working tool and a bucket cylinder C4 as a working tool cylinder.

As illustrated in FIGS. 1 and 2, the boom 11 includes a boom proximal portion 11A, a boom distal portion 11B, and a boom body portion 11C. The boom proximal portion 11A is pivotally supported by the swing bracket 10 via a boom support shaft 35. Specifically, the boom proximal portion 11A is supported swingably (turnably) by a first pivotal support 23 of the swing bracket 10 via the boom support shaft 35 that has an axis extending in the machine-body width direction. That is, the boom 11 swings up and down (swings upward and downward) about the boom support shaft 35.

Figure 3:
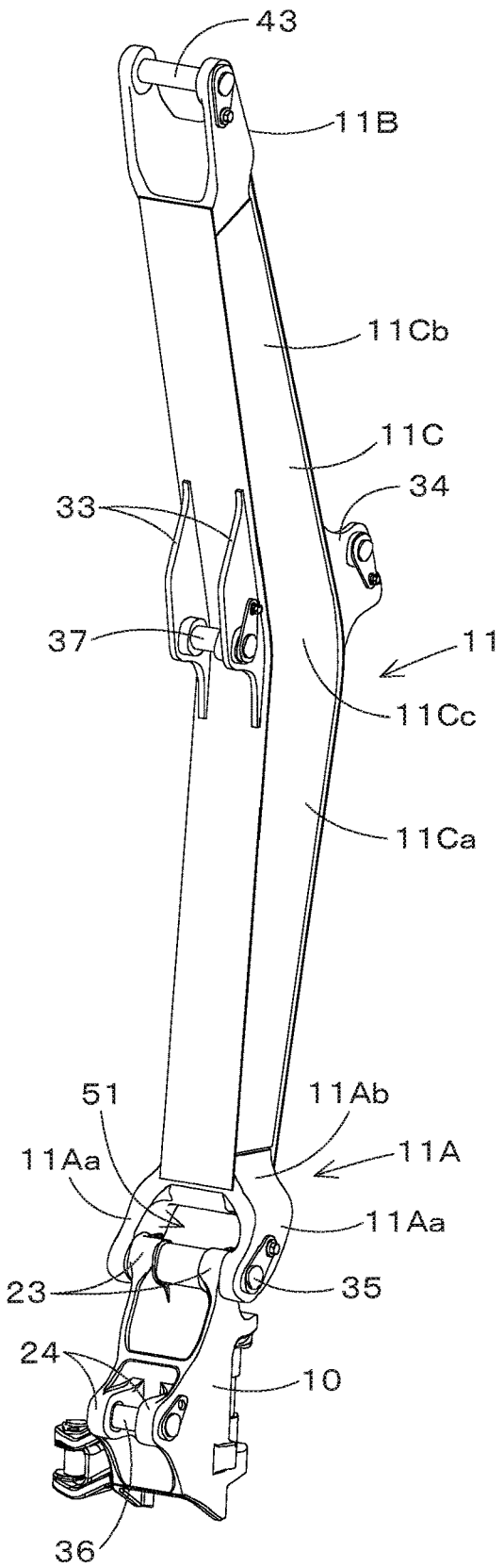
FIG. 3 is a perspective view of a boom pivotally supported by a swing bracket.

As illustrated in FIG. 3, the boom proximal portion 11A forks into two branches. Specifically, the boom proximal portion 11A includes pivotal support sections 11Aa pivotally supported via the boom support shaft 35 and the connected section 11Ab connected to the boom body portion 11C (first section 11Ca). A pair of the pivotal support sections 11Aa are provided in the machine-body width direction and arranged such that the first pivotal support 23 is located between the left pivotal support section 11Aa and the right pivotal support section 11Aa in the machine-body width direction. A space 51 is defined between the connected section 11Ab and the swing bracket 10 and between the connected section 11Ab and the first pivotal supports 23.

As illustrated in FIG. 2, the boom proximal portion 11A is bent between the connected section 11Ab and the pivotal support sections 11Aa (at an intermediate portion in a boom longitudinal direction which is the longitudinal direction of the boom 11). In other words, the boom proximal portion 11A includes a bent portion between the connected section 11Ab and the pivotal support sections 11Aa.

As illustrated in FIGS. 1 and 2, the boom distal portion 11B swingably supports the arm 12. Specifically, the boom distal portion 11B pivotally supports a proximal portion of the arm 12 such that the arm 12 is swingable via an arm support shaft 43 that has an axis extending in the machine-body width direction. As illustrated in FIG. 3, the boom distal portion 11B forks into two branches and is positioned such that the proximal portion of the arm 12 is located between the two branches.

As illustrated in FIGS. 1 and 2, the boom body portion 11C is provided between the boom proximal portion 11A and the boom distal portion 11B. The boom body portion 11C, which is obtained by welding together side edges of four plates that are long in the longitudinal direction (boom longitudinal direction) of the boom 11, is in the form of a quadratic prism having a quadrangular cross section perpendicular to the boom longitudinal direction, and the boom body portion 11C is bent at an intermediate portion. Specifically, the boom body portion 11C is bent at an intermediate portion 11Cc in the boom longitudinal direction and includes the first section 11Ca which is a portion between the intermediate portion (bent portion) 11Cc and the boom proximal portion 11A, and a second section 11Cb which is a portion between the intermediate portion 11Cc and the boom distal portion 11B. That is, the boom body portion 11C is bent between the first section 11Ca and the second section 11Cb. A lower bracket 33 is provided at the front side of the intermediate portion 11Cc (bent portion) of the boom body portion 11C, and an upper bracket 34 is provided at the back side (upper side) of the intermediate portion 11Cc (bent portion) of the boom body portion 11C.

As illustrated in FIG. 2, the boom 11 is configured such that, when the swing bracket 10 and the boom 11 are oriented in a forward direction from the machine body and the boom 11 is in its raised position 19, the first section 11Ca extends upward from the boom proximal portion 11A toward the intermediate portion 11Cc and the second section 11Cb extends diagonally forward and upward from the intermediate portion 11Cc. In the working machine 1 of the present embodiment, the boom 11 is configured such that the boom 11 is located forward of the canopy (cabin) 5 such that the boom 11 overlaps the canopy (cabin) 5 in front view, and that, when the boom 11 is in the raised position 19, an upward swing of the boom 11 stops at a position at which the boom 11 does not interfere with the canopy (cabin) 5. In the present embodiment, the raised position 19 illustrated in FIGS. 1 and 2 indicates the fully raised position of the boom 11.

The boom proximal portion 11A is bent such that, when the boom 11 is in the raised position 19, the pivotal support sections 11Aa extend in a diagonally upward and rearward direction from the boom support shaft 35 and the connected section 11Ab extends upward from the pivotal support sections 11Aa.

Figure 7:
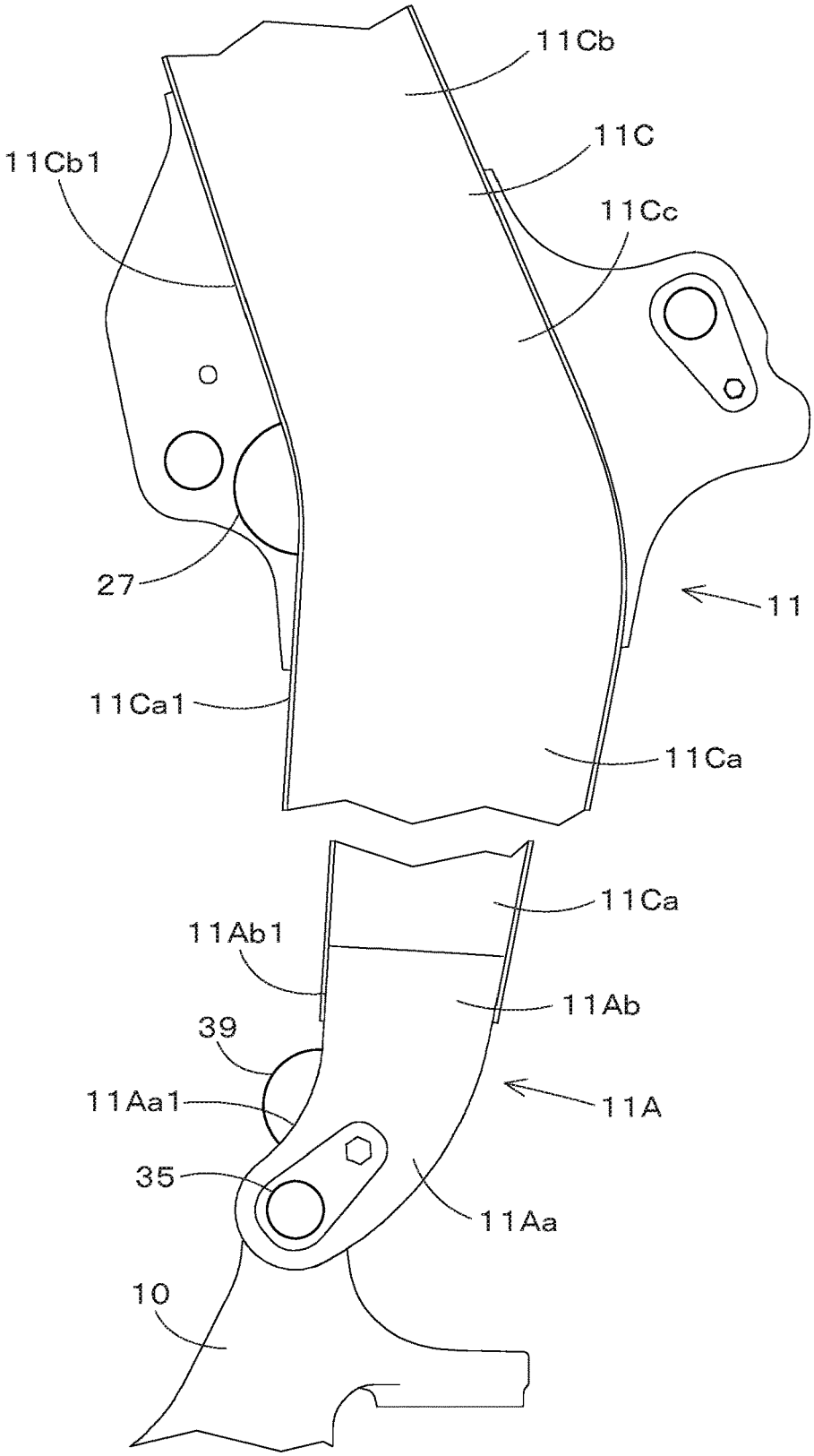
FIG. 7 is a side view describing the shape of a boom.

As illustrated in FIG. 7, an included bend angle (first bend angle) 27 of the boom body portion 11C (boom 11) is larger than an included bend angle (second bend angle) 39 of the boom proximal portion 11A. The first bend angle 27 is the angle between a front surface 11Ca1 of the first section 11Ca and a front surface 11Cb1 of the second section 11Cb. The second bend angle 39 is the angle between a front surface 11Aa1 of the pivotal support sections 11Aa and a front surface 11Ab1 of the connected section 11Ab.

The boom 11 is not limited to a boom having the aforementioned structure. While the boom proximal portion 11A and the boom distal portion 11B are each provided separately from the boom body portion 11C, the boom 11 may be a single-part boom including the boom proximal portion 11A, the boom distal portion 11B, and the boom body portion 11C. The boom proximal portion 11A does not need to be bent. The boom proximal portion 11A and the boom distal portion 11B each do not need to fork into two branches. While the boom proximal portion 11A and the boom distal portion 11B are made of cast iron and the boom body portion 11C is obtained by welding four plates into a tubular shape in the present embodiment, materials for the boom proximal portion 11A, the boom distal portion 11B, and the boom body portion 11C are not limited to those mentioned above.

As illustrated in FIG. 2, the boom cylinder C2 is a hydraulic cylinder (hydraulic actuator) that can be extended and retracted to swing (turn) the boom 11. Specifically, the boom cylinder C2 is located on the front side of the boom 11 (located forward of the boom 11 as seen from the machine body). The boom cylinder C2 is pivotally supported at a first end on the front side of the boom body portion 11C via a cylinder support shaft (first cylinder support shaft) 37 that has an axis in the machine-body width direction and is pivotally supported at a second end by the swing bracket 10 via a cylinder support shaft (second cylinder support shaft) 36 that has an axis in the machine-body width direction, and the boom cylinder C2 swings the boom 11 by being extended and retracted.

More specifically, the boom cylinder C2 includes a tubular cylinder portion 32A and a rod 32B having a first end slidably inserted in the cylinder portion 32A. The boom cylinder C2 is positioned on one side of the boom 11 such that the boom cylinder C2 is opposite the arm 12 when the arm 12 swings in an arm crowd direction D1. That is, the boom cylinder C2 is located at a lower area on the front side (front surface side) of the boom 11. A distal end portion (projecting end portion of the rod 32B) of the boom cylinder C2 is swingably supported by the lower bracket 33 via the first cylinder support shaft 37. A proximal end portion (bottom side of the cylinder portion 32A) of the boom cylinder C2 is swingably supported by second pivotal support(s) 24 of the swing bracket 10 via the second cylinder support shaft 36. Therefore, the boom device 30 (boom 11) is turnable about the boom support shaft 35 of the first pivotal support 23, and the boom device 30 (boom 11) is swingable up and down. Note that the boom cylinder C2 may include, on a surface thereof facing the arm 12 (lower side), a guard member (cylinder guard) that prevents contact of another object with the rod 32B and/or the cylinder portion 32A.

As illustrated in FIG. 2, the arm 12 has a shape that is long in the longitudinal direction. The proximal portion of the arm 12 is swingably supported by the boom distal portion 11B of the boom 11 via the arm support shaft 43. An upper bracket 44 is provided on the upper surface of the proximal portion of the arm 12.

As illustrated in FIG. 2, the arm cylinder C3 is a hydraulic cylinder (hydraulic actuator) that can be extended and retracted to swing the arm 12. A proximal end portion of the arm cylinder C3 is supported swingably by the upper bracket 34 of the boom 11 via a cylinder support shaft (third cylinder support shaft) 38 that has an axis in the machine-body width direction, and a distal end portion of the arm cylinder C3 is swingably supported by the upper bracket 44 via a cylinder support shaft (fourth cylinder support shaft) 46 that has an axis in the machine-body width direction. Therefore, the arm device 40 (arm 12) is turnable about the arm support shaft 43 of the boom 11, and the arm device 40 (arm 12) is swingable up and down (forward and rearward). That is, as illustrated in FIG. 2, the arm 12 is pivotally supported by the boom 11 swingably in the arm crowd direction D1 toward the boom 11 and an arm dump direction D2 away from the boom 11. In the present embodiment, extension (stroke in a direction that causes the arm 12 to swing in the arm crowd direction DO of the arm cylinder C3 swings the arm 12 in the arm crowd direction D1, and retraction (stroke in a direction that causes the arm 12 to swing in the arm dump direction D2) of the arm cylinder C3 swings the arm 12 in the arm dump direction D2.

As illustrated in FIG. 2, the bucket 13 is swingably supported by a distal end portion of the arm 12 via a pivot (bucket support shaft) 57 that has an axis in the machine-body width direction. A link mechanism 53 is provided between the bucket 13 and the distal end portion of the arm 12. The bucket 13 includes a bucket body 13*a* which is a portion that shovels earth, sand, and/or the like, and an attachment bracket 13*c* which is a portion that is attached to the arm 12 and to the link mechanism 53. The bucket body 13*a* includes a bottom surface 13*b* and a distal end portion (claw portion) 58.

As illustrated in FIG. 2, the bucket cylinder C4 is a hydraulic cylinder (hydraulic actuator) that can be extended and retracted to swing the bucket 13. A proximal end portion of the bucket cylinder C4 is swingably supported by the upper bracket 44 of the arm 12 via a cylinder support shaft (fifth cylinder support shaft) 48 that has an axis extending in the machine-body width direction. A distal end portion of the bucket cylinder C4 is supported by a cylinder support shaft (sixth cylinder support shaft) 56 of the link mechanism 53 swingably about an axis extending in the machine-body width direction. Therefore, the working tool device 50 (bucket 13) is provided at the distal end of the arm 12 to perform crowding (shoveling) and dumping. Crowding (shoveling) is an action in which the distal end portion 58 of the bucket 13 is swung in a bucket crowd direction (working-tool crowd direction) D3 which is a direction toward the boom 11 (arm 12), and is, for example, an action to shovel earth, sand, and/or the like. Dumping is an action in which the distal end portion 58 of the bucket 13 is swung in a bucket dump direction (working-tool dump direction) D4 which is a direction away from the boom 11 (arm 12), and is, for example, an action to drop (discharge) shoveled earth, sand, and/or the like.

Therefore, as illustrated in FIG. 2, the bucket 13 is swingable between a bucket crowd position (working-tool crowd position) Y1 in which the bucket cylinder C4 is fully extended (extended fully in a direction that causes the bucket 13 to move in the bucket crowd direction D3) and in which the distal end portion 58 is closest to the arm 12, and a bucket dump position (working-tool dump position) Y2 in which the bucket cylinder C4 is fully retracted (retracted fully in a direction that causes the bucket 13 to move in the bucket dump direction D4) and in which the distal end portion 58 is farthest from the arm 12. In FIG. 2, M3 indicates a swing path of the distal end portion 58 when the bucket 13 moves between the bucket crowd position Y1 and the bucket dump position Y2.

Instead of or in addition to the bucket 13, another working tool(s) (hydraulic attachment) that can be driven by hydraulic actuator(s) can be attached to the working machine 1. Examples of the other working tool include a hydraulic breaker, a hydraulic crusher, an angle boom, an earth auger, a pallet fork, a sweeper, a mower, a snow blower, and the like.

Figure 4:
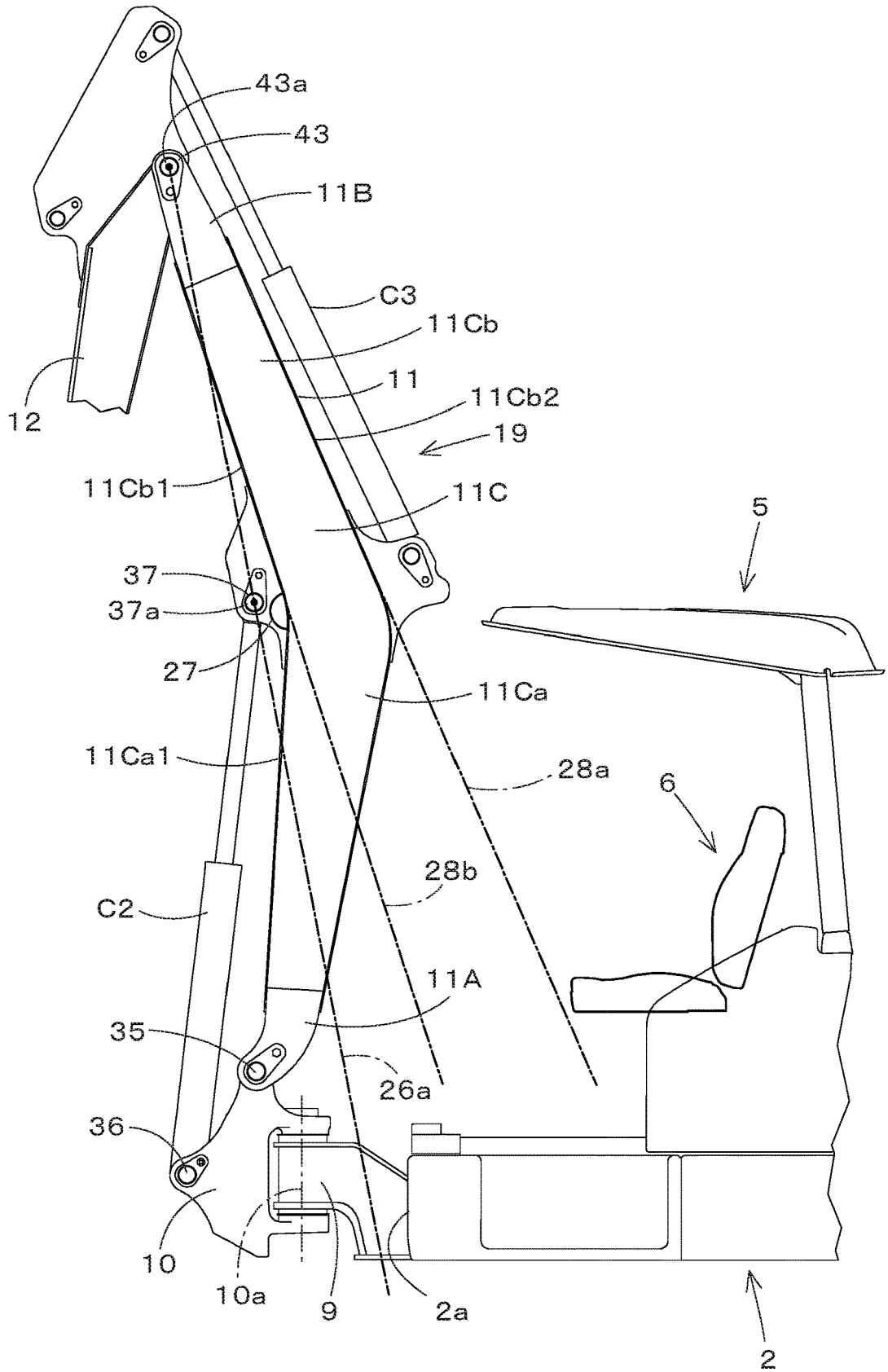
FIG. 4 is a side view describing the shape of a boom.

As illustrated in FIG. 4, the boom 11 is configured such that, when the boom 11 is in the raised position 19, a straight line (first straight line) 26*a* orthogonal to the arm support shaft 43 (an axis 43*a* of the arm support shaft 43) and to the first cylinder support shaft 37 (an axis 37*a* of the first cylinder support shaft 37) and extending downward from the first cylinder support shaft 37 passes forward of the machine body 2. In the present embodiment, the first straight line 26*a* intersects the support bracket 9 at a location rearward of the swing bracket 10.

The boom of an existing working machine that has a swing function is configured such that, when the boom is in a fully raised position, a straight line (first straight line of the existing working machine) orthogonal to the axis of an arm support shaft and to the axis of a first cylinder support shaft and extending downward from a first cylinder support shaft intersects the machine body (swivel base) (passes through the center of a machine body in the front-rear direction or its surrounding area). In contrast, the boom 11 in the present embodiment is configured such that the first straight line 26*a* passes forward of the machine body 2. That is, an inclination angle of the first straight line 26*a* in the present embodiment with respect to the horizontal line is larger than an inclination angle of the first straight line in the existing working machine with respect to the horizontal line. The inclination angle of the first straight line 26*a* with respect to the horizontal line increases as the bend angle 27 of the boom 11 increases. Therefore, with the configuration in which the first straight line 26*a* passes forward of the machine body 2, the boom 11 in the present embodiment is configured such that the bend angle 27 of the boom 11 is larger (shallower) than the bend angle of the boom in the existing working machine.

By using the bend angle 27 of the boom 11 larger than that in the existing working machine, it is possible to raise the position of the distal end of the boom 11 (raise the bucket height which is the heightwise position of the bucket 13). It is also possible to reduce the weight of the boom 11 (achieve a lightweight boom 11).

Figure 8:
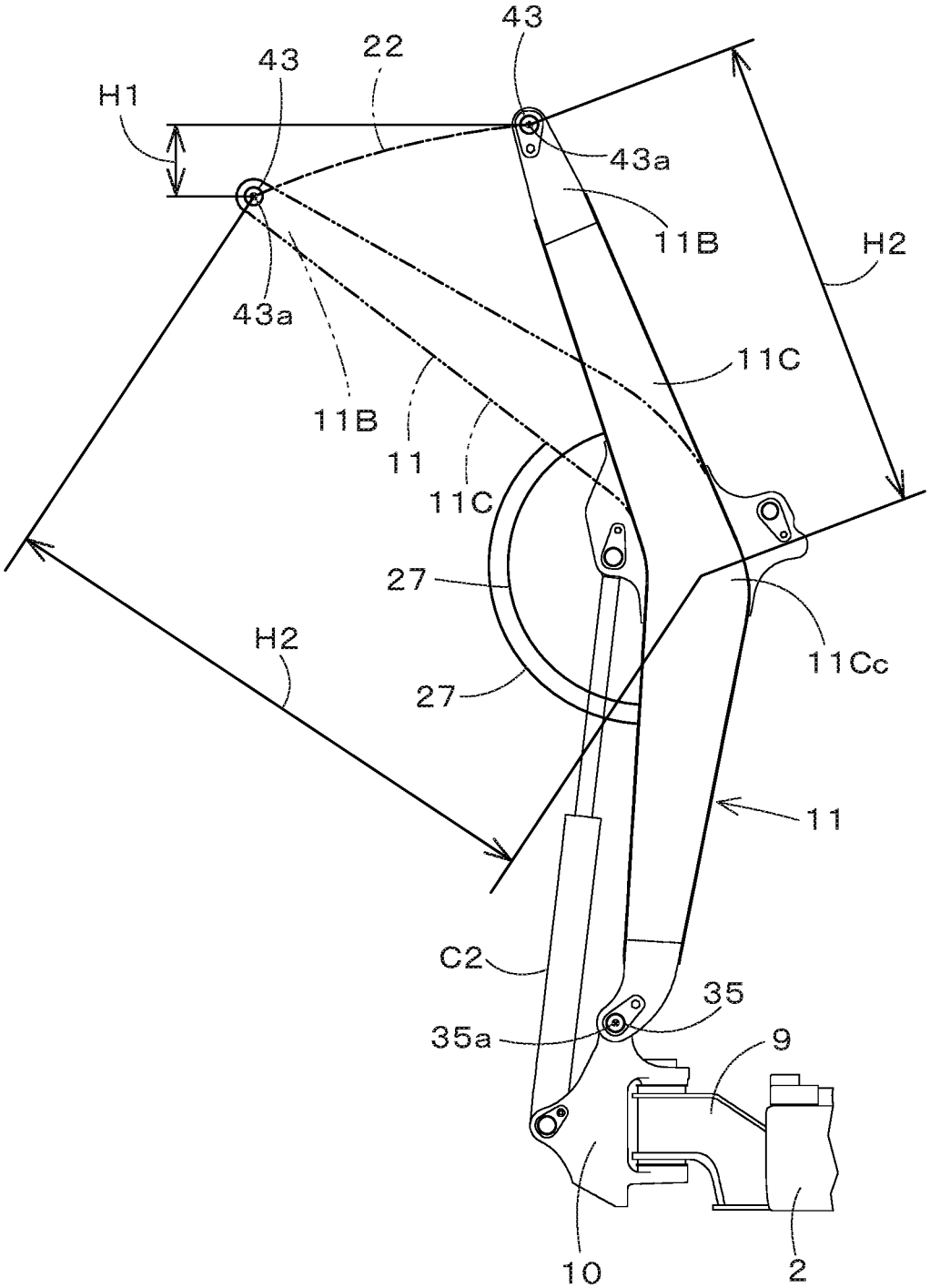
FIG. 8 is a side view describing an effect of a boom according to the present embodiment.

This is described specifically with reference to FIG. 8. In FIG. 8, solid lines indicate the boom in the present embodiment, and dashed double-dotted lines indicate an upper portion of the boom 11 where the bend angle 27 of the boom 11 is smaller than that in the present embodiment (for example, the boom 11 in the existing working machine). The sign 22 indicates an arc centered on an axis 35*a* of the boom support shaft 35 and passing through the axis 43*a* of the arm support shaft 43 (an arc whose radius is a line that connects the axis 35*a* of the boom support shaft 35 and the axis 43*a* of the arm support shaft 43). The existing working machine and the present embodiment are different from each other in that, as illustrated in FIG. 8, the heightwise position of the arm support shaft 43 is higher in the present embodiment by H1 than in the existing working machine, and a distance H2 between the arm support shaft 43 and the intermediate portion 11Cc of the boom body portion 11C is smaller in the present embodiment than in the existing working machine, assuming that the dimension of a straight line orthogonal to the arm support shaft 43 and to the boom support shaft 35 is the same between the existing working machine and the present embodiment. That is, in contrast to the existing working machine, in the present embodiment, it is possible to raise the position of the distal end of the boom 11 and possible to reduce the weight of the boom 11 because the bend angle 27 of the boom is increased.

The bend angle 27 of the boom 11 in the present embodiment is, for example, 140° to 170°. Preferably, the bend angle 27 is 145° to 165°. More preferably, the bend angle 27 is 150° to 160°.

In the present embodiment, as illustrated in FIG. 4, the boom 11 is configured such that a first extension line 28*a* which is an extension line of a back surface 11Cb2 of the second section 11Cb in a side view when the boom 11 is in the raised position 19 and which extends downward from the back surface 11Cb2 of the second section 11Cb passes forward of the operator's seat 6.

The boom of an existing working machine that has a swing function is configured such that an extension line (first extension line in the existing working machine) extending downward from the back surface of a second section in a side view when the boom is in a fully raised position passes through a rear portion (backrest portion) of an operator's seat. In contrast, the boom 11 in the present embodiment is configured such that the first extension line 28*a* passes forward of the operator's seat 6. That is, an inclination angle of the first extension line 28*a* with respect to the horizontal line is larger than an inclination angle of the first extension line in the existing working machine with respect to the horizontal line. The inclination angle of the first extension line 28*a* with respect to the horizontal line increases as the bend angle 27 of the boom 11 increases. Therefore, with the configuration in which the first extension line 28*a* passes forward of the operator's seat 6, the boom 11 in the present embodiment is configured such that the bend angle 27 of the boom 11 is larger (shallower) than the bend angle of the boom in the existing working machine. Thus, it is possible to raise the position of the distal end of the boom 11 and possible to reduce the weight of the boom 11.

In the present embodiment, as illustrated in FIG. 4, the boom 11 is configured such that a second extension line 28*b* which is an extension line of the front surface 11Cb1 of the second section 11Cb when the boom 11 is in the raised position 19 and which extends downward from the front surface 11Cb1 of the second section 11Cb passes forward of the operator's seat 6.

The boom of an existing working machine that has a swing function is configured such that an extension line (second extension line in the existing working machine) extending downward from the front surface of a second section when the boom is in a fully raised position passes through a front portion (seat portion) of an operator's seat. In contrast, the boom 11 in the present embodiment is configured such that the second extension line 28*b* passes forward of the operator's seat 6. That is, an inclination angle of the second extension line 28*b* with respect to the horizontal line is larger than an inclination angle of the second extension line in the existing working machine with respect to the horizontal line. The inclination angle of the second extension line 28*b* with respect to the horizontal line increases as the bend angle 27 of the boom 11 increases. Therefore, with the configuration in which the second extension line 28*b* passes forward of the operator's seat 6, the boom 11 in the present embodiment is configured such that the bend angle 27 of the boom 11 is larger (shallower) than the bend angle of the boom of the existing working machine. Thus, it is possible to raise the position of the distal end of the boom 11 and possible to reduce the weight of the boom 11.

Figure 5:
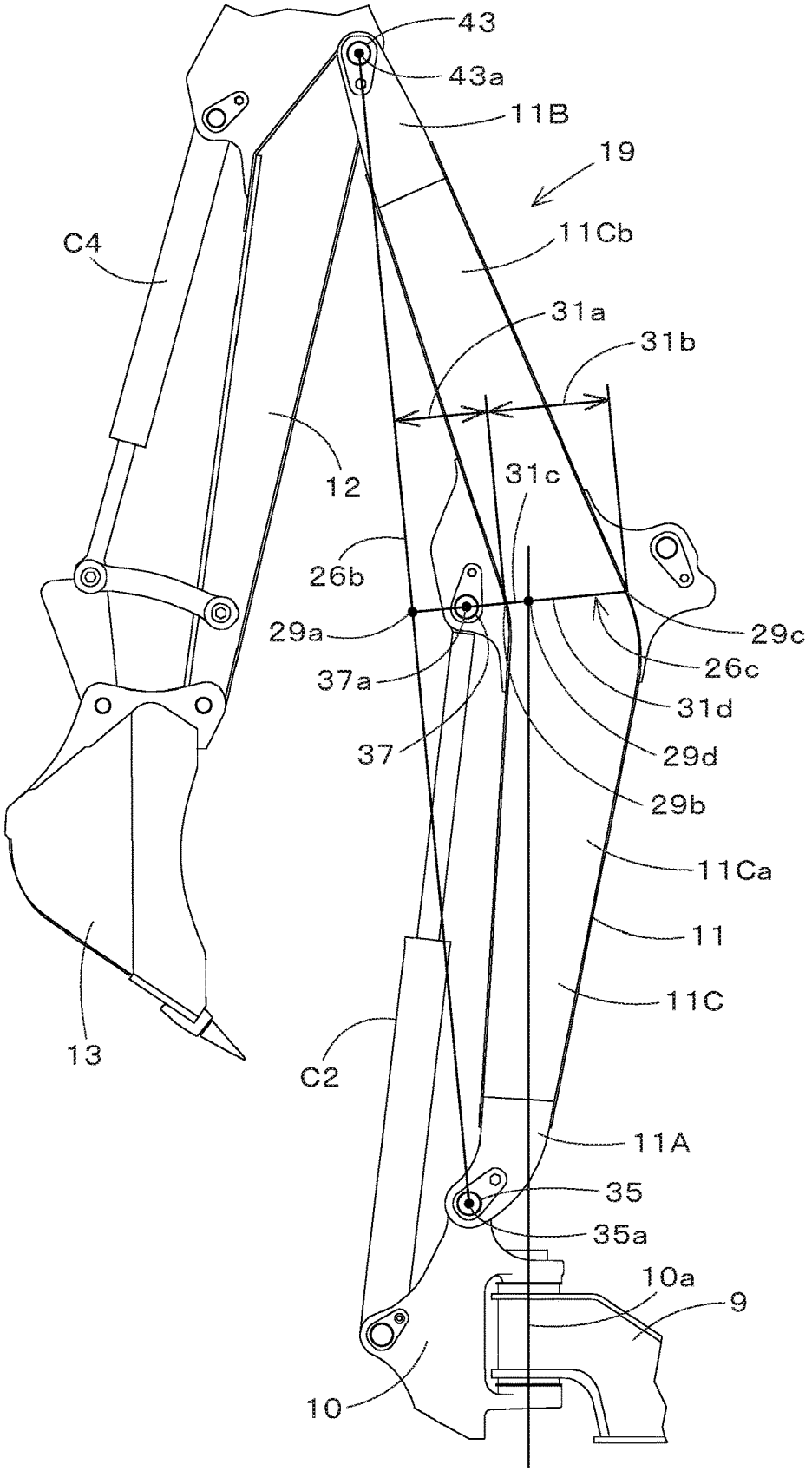
FIG. 5 is a side view describing the shape of a boom.

As illustrated in FIG. 5, assume that, when the boom 11 is in the raised position 19, a straight line orthogonal to the arm support shaft 43 (to the axis 43*a* of the arm support shaft 43) and to the boom support shaft 35 (to the axis 35*a* of the boom support shaft 35) is a second straight line 26*b*, a straight line orthogonal to the second straight line 26*b* and to the first cylinder support shaft 37 (to the axis 37*a* of the first cylinder support shaft 37) is a third straight line 26*c*, an intersection of the second straight line 26*b* and the third straight line 26*c* is a first intersection 29*a*, an intersection of the third straight line 26*c* and the front surface of the boom body portion 11C is a second intersection 29*b*, and an intersection of the third straight line 26*c* and the back surface of the boom body portion 11C is a third intersection 29*c*. In such a case, a first distance 31*a* between the first intersection 29*a* and the second intersection 29*b* is smaller than a second distance 31*b* between the second intersection 29*b* and the third intersection 29*c* in the present embodiment.

In an existing working machine that has a swing function, since the bend angle of a boom is a small, an arm support shaft is located diagonally forward and downward of the arm support shaft 43 of the present embodiment, and the first distance is larger than the second distance. As the bend angle of the boom is increased, the arm support shaft moves rearward and upward, reducing the first distance. Therefore, the bend angle 27 of the boom 11 is larger in the present embodiment than that in the existing working machine because the first distance 31*a* is smaller than the second distance 31*b*. Thus, it is possible to raise the position of the distal end of the boom 11 and possible to reduce the weight of the boom 11.

As illustrated in FIG. 5, assume that the intersection of the swing axis 10*a* and the third straight line 26*c* when the boom 11 is in the raised position 19 is a fourth intersection 29*d*. In such a case, a third distance 31*c* between the second intersection 29*b* and the fourth intersection 29*d* is smaller than a fourth distance 31*d* between the third intersection 29*c* and the fourth intersection 29*d* in the present embodiment.

Figure 6:
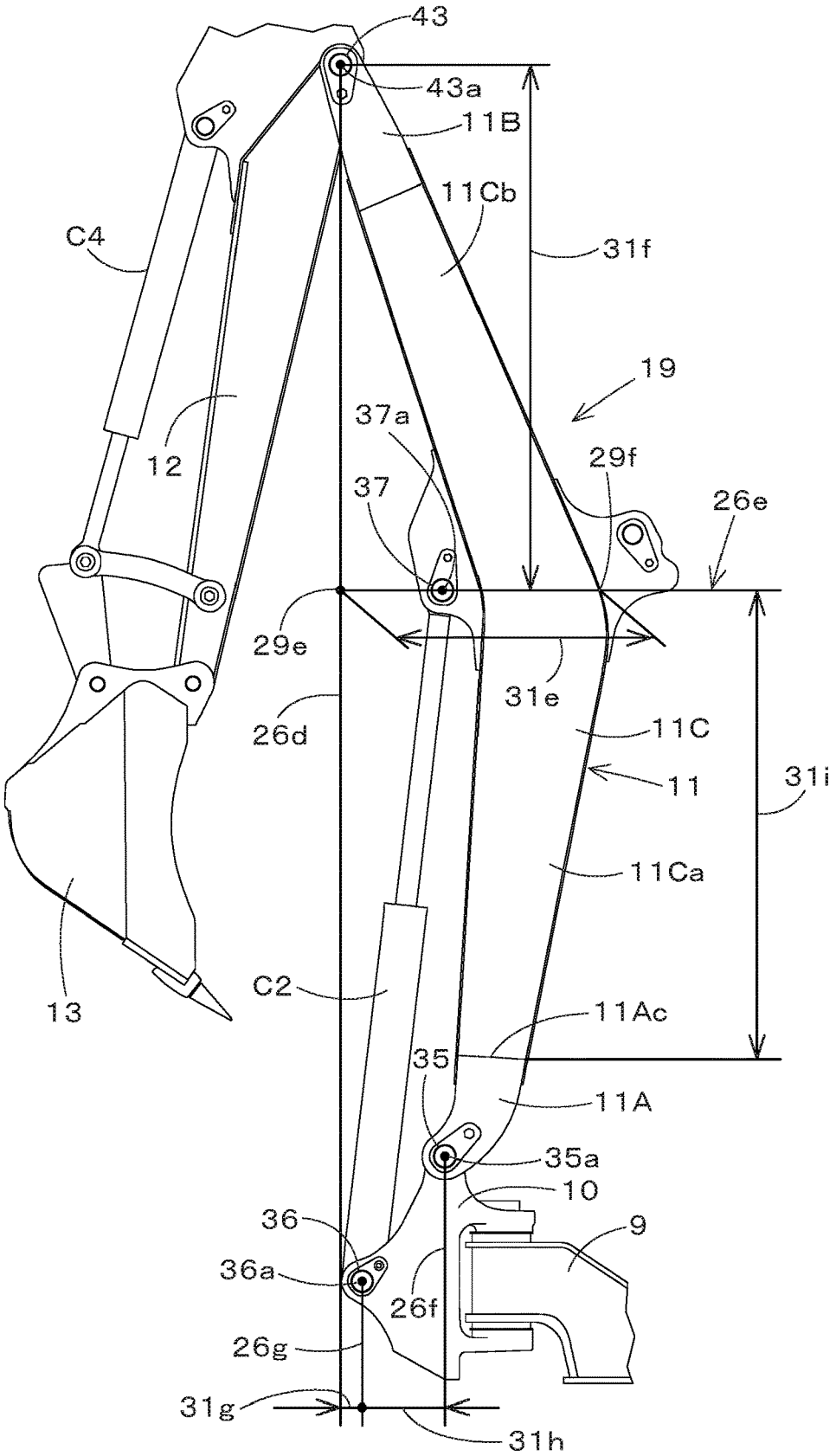
FIG. 6 is a side view describing the shape of a boom.

As illustrated in FIG. 6, assume that, when the boom 11 is in the raised position 19, a vertical line orthogonal to the arm support shaft 43 (to the axis 43*a* of the arm support shaft 43) is a fourth straight line 26*d*, a straight line orthogonal to the fourth straight line 26*d* and to the first cylinder support shaft 37 (to the axis 37*a* of the first cylinder support shaft 37) is a fifth straight line 26*e*, an intersection of the fourth straight line 26*d* and the fifth straight line 26*e* is a fifth intersection 29*e*, and an intersection of the fifth straight line 26*e* and the back surface of the boom body portion 11C is a sixth intersection 29*f*. In such a case, a fifth distance 31*e* between the fifth intersection 29*e* and the sixth intersection 29*f* is smaller than a sixth distance 31*f* between the axis 43*a* of the arm support shaft 43 and the fifth intersection 29*e* in the present embodiment.

As the bend angle of the boom is increased when the fifth distance is larger than the sixth distance, the fourth straight line and the fifth intersection approach an intermediate portion of the boom, decreasing the fifth distance, as the bend angle of the boom increases. Since the fifth distance 31*e* is smaller than the sixth distance 31*f* in the present embodiment, it is possible to raise the position of the distal end of the boom 11 and possible to reduce the weight of the boom 11.

As illustrated in FIG. 6, assume that, when the boom 11 is in the raised position 19, a vertical line orthogonal to the boom support shaft 35 (to the axis 35*a* of the boom support shaft 35) is a sixth straight line 26*f* and a vertical line orthogonal to the second cylinder support shaft 36 (to an axis 36*a* of the second cylinder support shaft 36) is a seventh straight line 26*g*. In such a case, a seventh distance 31*g* between the fourth straight line 26*d* and the seventh straight line 26*g* is smaller than an eighth distance 31*h* between the sixth straight line 26*f* and the seventh straight line 26*g* in the present embodiment.

The seventh distance is larger than the eighth distance in an existing working machine that has a swing function. As the bend angle of the boom is increased, the fourth straight line approaches an intermediate portion of the boom, decreasing the seventh distance. Therefore, the bend angle 27 of the boom 11 is larger in the present embodiment than in the existing working machine because the seventh distance 31*g* is smaller than the eighth distance 31*h*. Thus, it is possible to raise the position of the distal end of the boom 11 and possible to reduce the weight of the boom 11.

As illustrated in FIG. 6, the sixth distance 31*f* is larger than a ninth distance 31*i* between the fifth straight line 26*e* and an upper edge 11Ac of a side surface of the boom proximal portion 11A in the vertical direction in the present embodiment.

The sixth distance is smaller than the ninth distance in an existing working machine that has a swing function. As the bend angle of the boom is increased, the arm support shaft moves rearward and upward and is raised, and the sixth distance increases. Therefore, the bend angle 27 of the boom 11 is larger in the present embodiment than in the existing working machine because the sixth distance 31*f* is larger than the ninth distance 31*i*. Thus, it is possible to raise the position of the distal end of the boom 11 and possible to reduce the weight of the boom 11.

Figure 9:
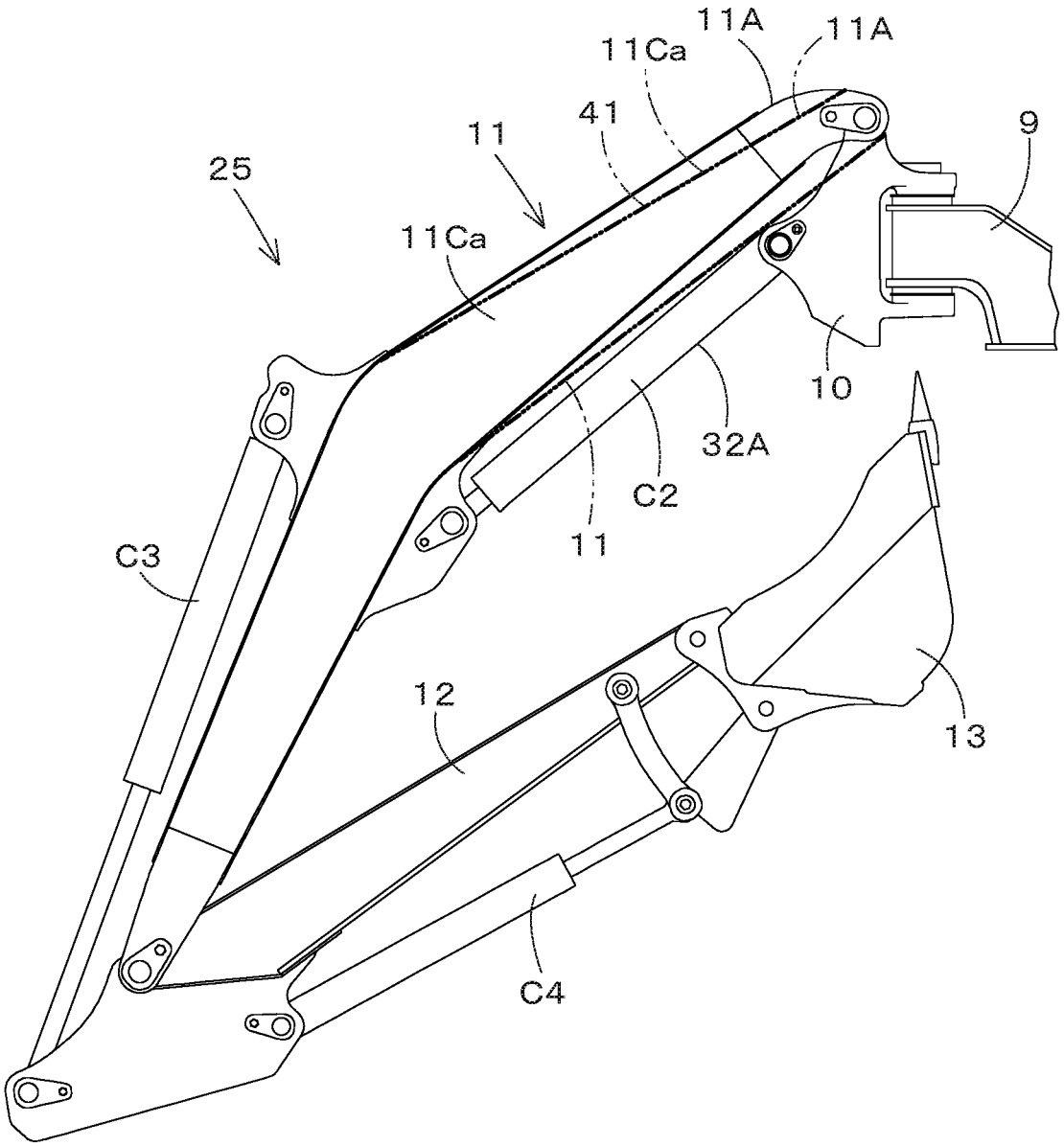
FIG. 9 is a side view of a boom in a lowered position.

FIG. 9 illustrates the boom 11 in its a lowered position 25. In FIG. 9, dashed double-dotted lines 41 indicate the first section 11Ca and the boom proximal portion 11A of the boom 11 in the case where the boom proximal portion 11A is not bent. With regard to the solid lines indicating the present embodiment, there is a gap (a gap to prevent the boom 11 and the boom cylinder C2 from interfering with each other) between the front surface of the boom 11 (first section 11Ca) and the boom cylinder C2 (cylinder portion 32A). However, the first section 11Ca of the boom 11 indicated by the dashed double-dotted lines 41 interferes with the boom cylinder C2 (cylinder portion 32A). Therefore, when the boom proximal portion 11A is not bent, it is not possible to lower the boom 11 to the lowered position 25 indicated by the solid lines. That is, when the boom proximal portion 11A is bent as in the present embodiment, the boom 11 can be lowered to a greater extent than when the boom proximal portion 11A is not bent. In other words, in the present embodiment, since the boom proximal portion 11A is bent, it is possible to lower the boom 11 to a position in which the boom 11 and the boom cylinder C2 would otherwise interfere with each other if the boom proximal portion 11A is not bent. Since the distal end of the boom 11 is sufficiently lowered when the boom 11 is in the lowered position 25, even though the bend angle 27 of the boom 11 is shallow, it is possible to ensure a digging depth. That is, in the present embodiment, it is also possible to ensure the digging depth in addition to raising of the height of the bucket 13 when the boom 11 is in the raised position 19 and reducing of the weight of the boom 11.

Figure 10:
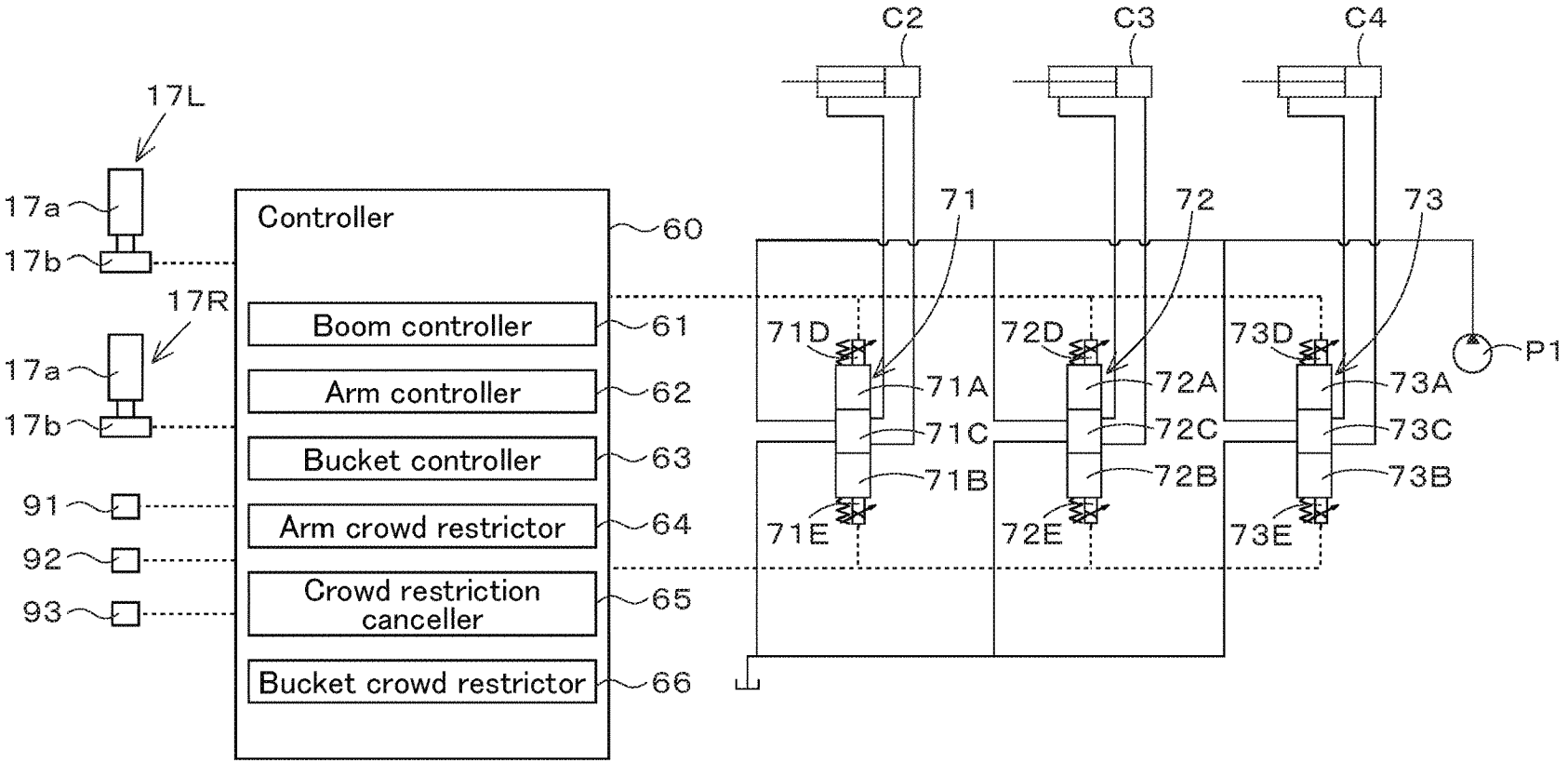
FIG. 10 illustrates a hydraulic system of a working machine.

FIG. 10 illustrates a hydraulic system of the working machine 1 that actuates the working device 4.

As illustrated in FIG. 10, the hydraulic system of the working machine 1 includes a boom control valve 71, an arm control valve 72, a bucket control valve 73, a controller 60, the manipulation devices 17L and 17R, a boom angle sensor 91, an arm angle sensor 92, and a working-tool angle sensor 93.

The boom control valve 71, the arm control valve 72, and the bucket control valve 73 are connected via fluid passages to the boom cylinder C2, the arm cylinder C3, and the bucket cylinder C4, respectively. A hydraulic pump P1 that delivers hydraulic fluid is connected to the boom control valve 71, the arm control valve 72, and the bucket control valve 73 via respective fluid passages.

The boom control valve 71, the arm control valve 72, and the bucket control valve 73 are each, for example, an electromagnetic three-position switching valve.

Specifically, the boom control valve 71 is a linear-motion-spool switching valve that can be switched between a first position 71A, a second position 71B, and a third position 71C by energizing or deenergizing a first solenoid 71D and/or a second solenoid 71E. When the boom control valve 71 is switched to the first position 71A, hydraulic fluid is supplied to and discharged from the boom cylinder C2 and therefore the boom cylinder C2 is extended, causing the boom 11 to swing in a rising direction. On the contrary, when the boom control valve 71 is switched to the second position 71B, hydraulic fluid is supplied to and discharged from the boom cylinder C2 and therefore the boom cylinder C2 is retracted, causing the boom 11 to swing in a lowering direction.

The arm control valve 72 is a linear-motion spool switching valve that can be switched between a first position 72A, a second position 72B, and a third position 72C by energizing or deenergizing a first solenoid 72D and/or a second solenoid 72E. When the arm control valve 72 is switched to the first position 72A, hydraulic fluid is supplied to and discharged from the arm cylinder C3 and therefore the arm cylinder C3 is extended, causing the arm 12 to swing in the arm crowd direction D1 (rearward and downward). On the contrary, when the arm control valve 72 is switched to the second position 72B, hydraulic fluid is supplied to and discharged from the arm cylinder C3 and therefore the arm cylinder C3 is retracted, causing the arm 12 to swing in the arm dump direction D2 (forward and upward).

The bucket control valve 73 is a linear-motion spool switching valve that can be switched between a first position 73A, a second position 73B, and a third position 73C by energizing or deenergizing a first solenoid 73D and/or a second solenoid 73E. When the bucket control valve 73 is switched to the first position 73A, hydraulic fluid is supplied to and discharged from the bucket cylinder C4 and therefore the bucket cylinder C4 is extended, causing the bucket 13 to swing in the working-tool crowd direction D3 (direction of shoveling). On the contrary, when the bucket control valve 73 is switched to the second position 73B, hydraulic fluid is supplied to and discharged from the bucket cylinder C4 and therefore the bucket cylinder C4 is retracted, causing the bucket 13 to swing in the dump direction D4.

The controller 60 includes a boom controller 61, an arm controller 62, and a bucket controller 63, and controls switching operations of the boom control valve 71, the arm control valve 72, and the bucket control valve 73. That is, the controller 60 controls the operations of the boom 11, the arm 12, and the bucket 13. The controller 60 may include logical circuit(s) (hardware) on integrated circuit(s) (IC chip(s)) or the like and may include software(s) on computer(s). In the latter case, the computer includes recording medium(media) storing therein program(s) which is software(s) that performs functions of the controller 60 and various data relating to the working machine 1 in a computer-readable form, arithmetic circuit(s) such as central processing unit(s) (CPU(s)) that executes instructions of the program(s), random access memory(memories) (RAMs) on which the program(s) and the various data are loaded, and/or the like. The arithmetic circuit(s) reads the program(s) from the recording medium(media) and executes the program(s), thus performing function(s) of the controller 60.

The manipulation devices 17L and 17R to be held by an operator during an operation are connected to the controller 60. The manipulation devices 17L and 17R are each provided in the vicinity of the operator's seat 6. The manipulation devices 17L and 17R each include an operation lever 17*a* and a position sensor 17*b*. The operation lever 17*a* is pivotable forward, rearward, rightward, and leftward from a neutral position, and the position sensor 17*b* detects forward, rearward, rightward, and leftward pivot amounts (the extent to which the lever is pivoted, or operation amount) of the operation lever 17*a* from the neutral position.

For example, when the operation lever 17*a* of the manipulation device 17R is pivoted forward or rearward by an operator, the extent to which the operation lever 17*a* is pivoted forward or rearward is input into the controller 60. In accordance with the obtained pivot direction and the obtained pivot amount of the operation lever 17*a*, the boom controller 61 (controller 60) energizes or deenergizes the first solenoid 71D and/or the second solenoid 71E, thus switching the boom control valve 71. That is, the boom controller 61 controls the swing of the boom 11.

When the operation lever 17*a* of the manipulation device 17L is pivoted forward or rearward by an operator, the extent to which the operation lever 17*a* is pivoted forward or rearward is input into the controller 60. In accordance with the obtained pivot direction and the obtained pivot amount of the operation lever 17*a*, the arm controller 62 (controller 60) energizes or deenergizes the first solenoid 72D and/or the second solenoid 72E, thus switching the arm control valve 72. That is, the arm controller 62 controls the swing of the arm 12.

When the operation lever 17*a* of the manipulation device 17R is pivoted leftward or rightward by an operator, the extent to which the operation lever 17*a* is pivoted leftward or rightward is input into the controller 60. In accordance with the obtained pivot direction and the obtained pivot amount of the operation lever 17*a*, the bucket controller 63 (controller 60) energizes or deenergizes the first solenoid 73D and/or the second solenoid 73E, thus switching the bucket control valve 73. That is, the bucket controller 63 controls the swing of the bucket 13.

The boom angle sensor 91, the arm angle sensor 92, and the bucket angle sensor (working-tool angle sensor) 93 are connected to the controller 60. The boom angle sensor 91 detects a swing angle θ2 (swing position) of the boom 11. The arm angle sensor 92 detects a swing angle θ3 (swing position) of the arm 12. The bucket angle sensor 93 detects a swing angle θ4 (swing position) of the bucket 13 about the pivot 57 with respect to the distal end portion of the arm 12. Potentiometers are used as the boom angle sensor 91, the arm angle sensor 92, and the bucket angle sensor 93 in the present embodiment. However, this does not imply any limitation, and other angle sensors may be used. Alternatively, a configuration in which strokes (the degree to which a cylinder is extended) of the boom cylinder C2, the arm cylinder C3, and the bucket cylinder C4 are detected and swing angles of the boom 11, the arm 12, and the bucket 13 are calculated from the results of the detection may be used.

Figure 11:
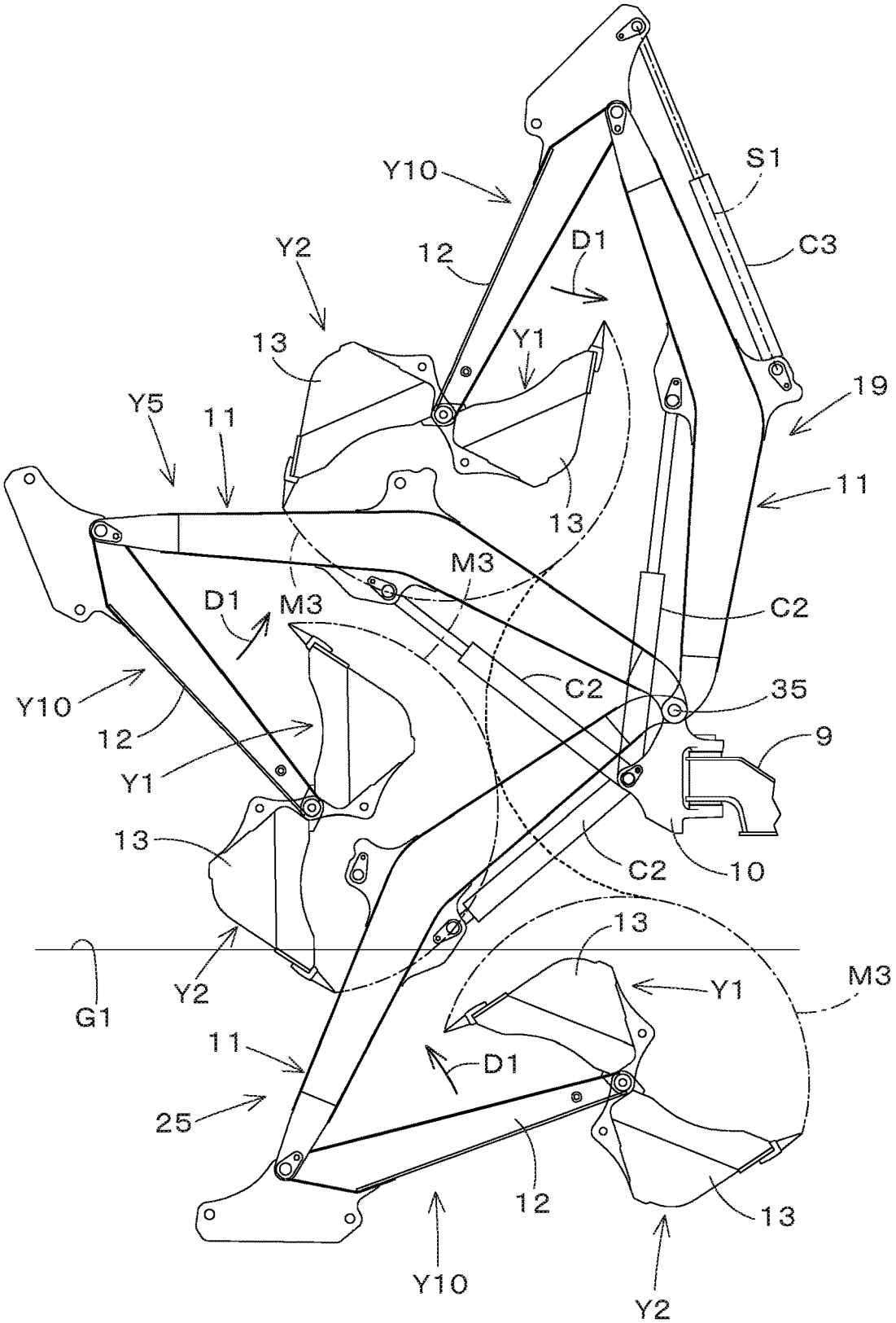
FIG. 11 illustrates how the swing position of a boom changes.

As illustrated in FIG. 10, the controller 60 includes an arm crowd restrictor 64. The arm crowd restrictor 64 limits a stroke S1 of the arm cylinder C3 in a direction that causes the arm to move in the arm crowd direction D1 such that, as illustrated in FIG. 11, a swing path M3 of the distal end portion 58 of the bucket (working tool) 13 and the boom cylinder C2 (a cylinder guard when the cylinder guard is present) are separated from each other by a predetermined distance or more. With this, it is possible to prevent the distal end portion 58 of the bucket 13 from interfering (coming into contact) with the boom cylinder C2.

FIG. 11 illustrates how the swing position of the boom 11 changes, the arm 12 in a restriction position Y10 in the arm crowd direction D1, and how the bucket 13 is swung from the bucket crowd position Y1 to the bucket dump position Y2. Specifically, how the swing position of the boom 11 changes indicates how the boom 11 is moved from the raised position (fully raised position) 19 to the lowered position (fully lowered position) 25, and the swing position Y5 indicates an intermediate position of the boom 11 between the raised position 19 and the lowered position 25. Outside a non-restricted region in which the stroke S1 is not limited (described later), the stroke S1 of the arm cylinder C3 in the direction that causes the arm to move in the arm crowd direction D1 is limited (arm-crowd restriction) such that the swing path M3 and the boom cylinder C2 (cylinder guard) are separated from each other by a predetermined distance or more. In FIG. 11, a dotted line R1 is a line that contacts the swing path M3 when the boom 11 swings between the fully raised position 19 and the fully lowered position 25 with the arm 12 in the restriction position Y10.

As illustrated in FIG. 10, the controller 60 includes a crowd restriction canceller 65. When specific work is to be performed by the working device 4, the crowd restriction canceller 65 cancels the arm crowd restriction so that the work can be effectively performed. The crowd restriction canceller 65 cancels the limit on the stroke S1 of the arm cylinder C3 to enable the arm 12 to swing to the end of the swing range in the arm crowd direction D1.

As illustrated in FIG. 10, the controller 60 includes a bucket crowd restrictor (working-tool crowd restrictor) 66. The bucket crowd restrictor 66 limits the swing of the bucket 13 in the bucket crowd direction D3 such that the swing path M3 of the distal end portion 58 of the bucket 13 and the boom cylinder C2 (a cylinder guard when the cylinder guard is present) are separated from each other by a predetermined distance or more, when the limit on the stroke S1 of the arm cylinder C3 is cancelled by the crowd restriction canceller 65. That is, the bucket crowd restrictor 66 limits the stroke of the bucket cylinder C4 in a direction that causes the bucket to move in the bucket crowd direction D3 such that the swing path M3 of the distal end portion 58 of the bucket 13 and the boom cylinder C2 are separated from each other by a predetermined distance or more.

An example of work performed by the working machine 1 is so-called "scooping work" in which soil is scooped by the bucket 13 using the front surface (blade surface) of the blade 7A of the dozer device 7.

Figure 12:
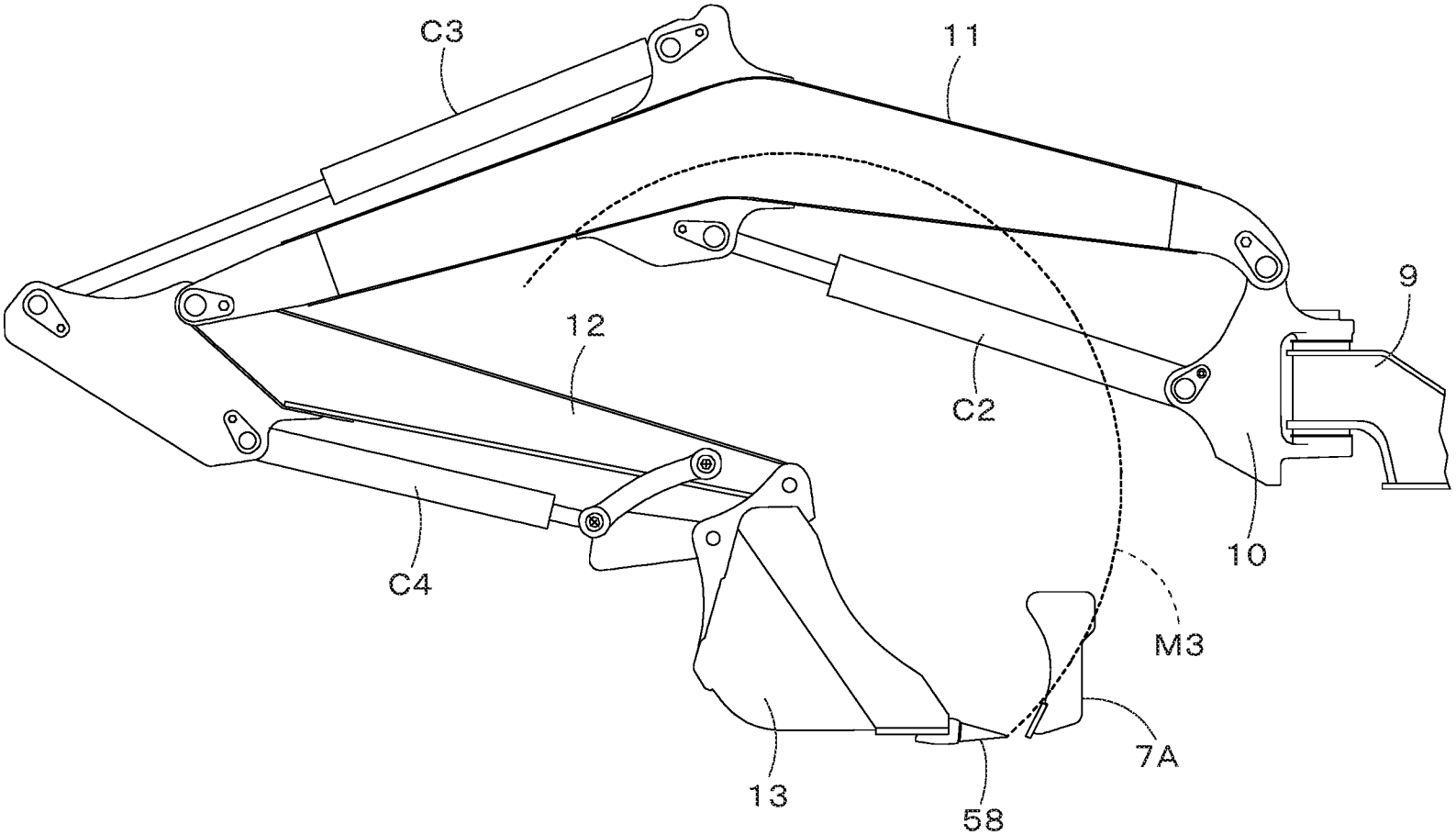
FIG. 12 is a side view of a state of scooping work.

As illustrated in FIG. 12, when the bend angle 27 of the boom 11 is large (shallow), in the "scooping work", the boom cylinder C2 and the distal end portion 58 of the bucket 13 come close to each other to interfere with the boom cylinder C2, compared with when the bend angle of the boom is small (deep) as in the existing working machine. In the existing working machine, since the bend angle of the boom is small (deep), the distal end portion of the bucket does not interfere with the boom cylinder in the "scooping work". However, in the present embodiment, it is possible, even though the bend angle 27 of the boom 11 is large, to prevent the distal end portion 58 of the bucket 13 from interfering (coming into contact) with the boom cylinder C2 by the arm crowd control, because, as described earlier, the arm crowd restrictor 64 is provided to perform the arm crowd restriction (arm crowd control) by which the stroke S1 of the arm cylinder C3 in the direction that causes the arm to move in the arm crowd direction D1 is limited such that the swing path M3 of the distal end portion 58 of the bucket 13 and the boom cylinder C2 are separated from each other by a predetermined distance or more.

While the limit on the stroke S1 of the arm cylinder C3 is cancelled by the crowd restriction canceller 65, the distal end portion 58 of the bucket 13 can be prevented from interfering (coming into contact) with the boom cylinder C2 by the bucket crowd restrictor 66 limiting the swing of the bucket 13 in the bucket crowd direction D3.

Figure 13:
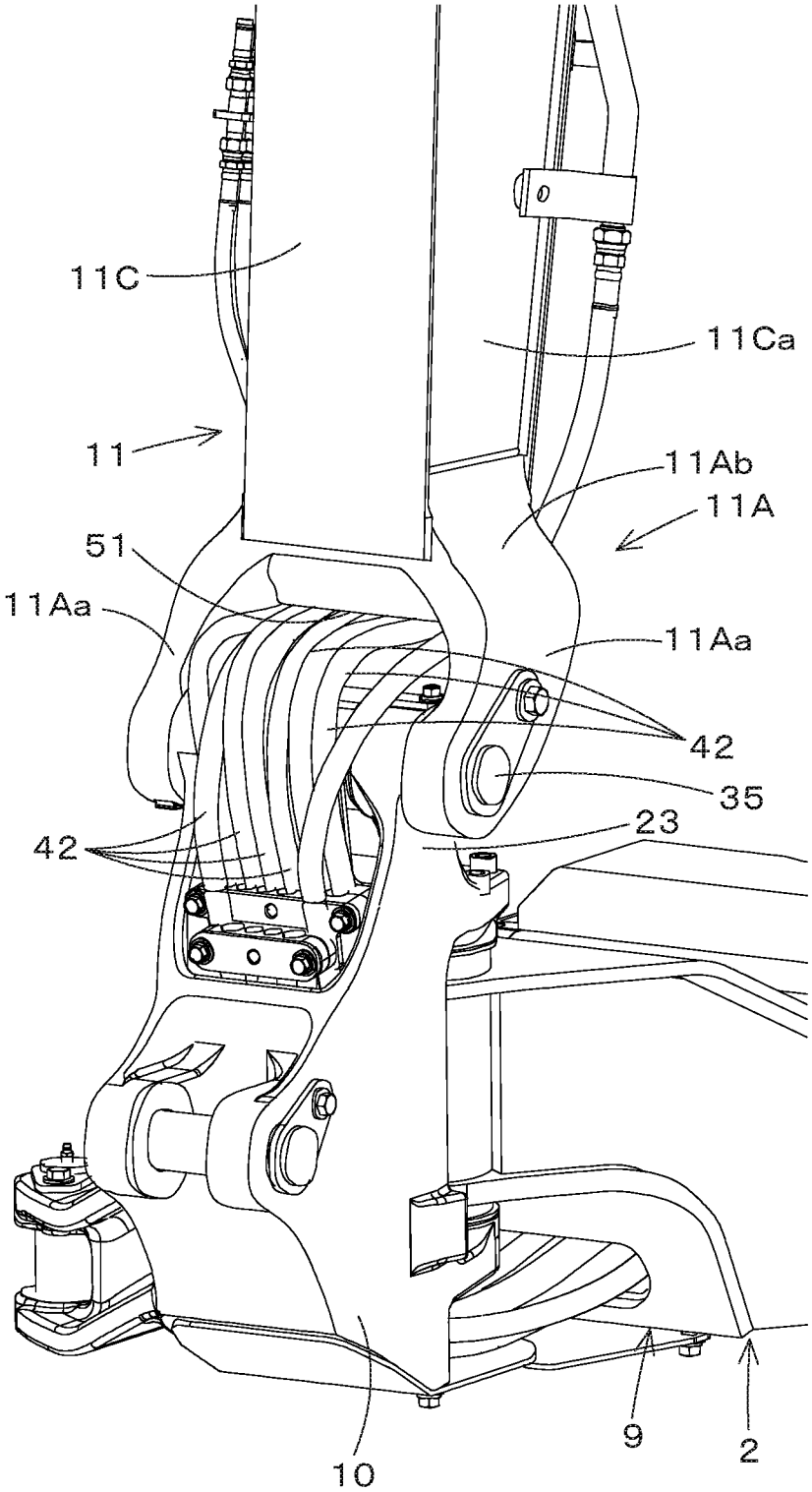
FIG. 13 is a perspective view illustrating the manner in which hydraulic hoses are guided.

As illustrated in FIGS. 3 and 13, the boom proximal portion 11A forks into two branches such that the pair of pivotal support sections 11Aa extend from the connected section 11Ab, the pair of pivotal support sections 11Aa are located such that the first pivotal support 23 of the swing bracket 10 is placed therebetween, and the space 51 is defined between the connected section 11Ab, the first pivotal support 23, and the boom support shaft 35. Therefore, as illustrated in FIG. 13, it is possible to pass hydraulic hose(s) 42 through the space 51. It is possible to guide the hydraulic hose(s) 42, which is/are guided from a lower portion of the support bracket 9 through the interior of the swing bracket 10 to an area forward of the boom support shaft 35, to an area behind the boom 11 through the space 51.

A working machine 1 according to one or more embodiments includes a machine body 2, a boom support (swing bracket 10) located forward of the machine body 2, a boom 11 to swing upward and downward about a boom support shaft 35, the boom 11 including a boom proximal portion 11A pivotally supported on the boom support 10 via the boom support shaft 35, a boom distal portion 11B to pivotally support an arm 12 via an arm support shaft 43 such that the arm 12 is swingable, and a boom body portion 11C bent at an intermediate portion 11Cc in a longitudinal direction of the boom, the boom body portion 11C being a portion between the boom proximal portion 11A and the boom distal portion 11B, and a boom cylinder C2 to extend and retract to cause the boom 11 to swing, the boom cylinder C2 being located on a front side of the boom 11 and including a first end pivotally supported on a front side of the boom body portion 11C via a first cylinder support shaft 37 and a second end pivotally supported on the boom support 10 via a second cylinder support shaft 36, wherein the boom 11 is configured such that, when the boom 11 is in a fully raised position 19 thereof, a first section 11Ca between the intermediate portion 11Cc and the boom proximal portion 11A extends upward from the boom proximal portion 11A toward the intermediate portion 11Cc and a second section 11Cb between the intermediate portion 11Cc and the boom distal portion 11B extends diagonally forward and upward from the intermediate portion 11Cc, and that a first straight line 26*a* orthogonal to the arm support shaft 43 and to the first cylinder support shaft 37 and extending downward from the first cylinder support shaft 37 passes forward of the machine body 2.

With this, in the working machine 1, the boom 11 is bent such that, when the boom 11 is in the fully raised position 19, the first section 11Ca of the boom body portion 11C extends upward from the boom proximal portion 11A toward the intermediate portion 11Cc and the second section 11Cb of the boom body portion 11C extends diagonally upward and forward from the intermediate portion 11Cc, and such a working machine 1 is configured such that the first straight line 26*a* orthogonal to the arm support shaft 43 and to the first cylinder support shaft 37 and extending downward from the first cylinder support shaft 37 passes forward of the machine body 2. With this, the bend angle 27 (the angle between the first section 11Ca and the second section 11Cb) of the boom 11 is larger than that of existing ones. This makes it possible to increase the height of the boom distal portion 11B when the boom 11 is in the fully raised position 19 and also possible to reduce the weight of the boom 11.

The working machine 1 may further include an operator's seat 6 mounted on the machine body 2. The boom 11 may be configured such that a first extension line 28*a* extending downward from a back surface of the second section 11Cb passes forward of the operator's seat 6, the first extension line being an extension of the back surface 11Cb2 of the second section 11Cb when the boom 11 is in the fully raised position 19.

Since this also increases the bend angle 27 of the boom 11, it is possible to increase the height of the boom distal portion 11B when the boom 11 is in the fully raised position 19 and also possible to reduce the weight of the boom 11.

The working machine 1 may further include an operator's seat 6 mounted on the machine body 2. The boom 11 may be configured such that a second extension line 28*b* extending downward from a front surface of the second section 11Cb passes forward of the operator's seat 6, the second extension line being an extension of the front surface 11Cb1 of the second section 11Cb when the boom 11 is in the fully raised position 19.

Since this also increases the bend angle 27 of the boom 11, it is possible to increase the height of the boom distal portion 11B when the boom is in the fully raised position 19 and also possible to reduce the weight of the boom 11.

When the boom 11 is in the fully raised position 19, a first distance 31*a* between a first intersection 29*a* and a second intersection 29*b* may be smaller than a second distance 31*b* between the second intersection 29*b* and a third intersection 29*c*, where the first intersection 29*a* is an intersection of a second straight line 26*b* and a third straight line 26*c*, the second intersection 29*b* is an intersection of the third straight line 26*c* and a front surface of the boom body portion 11C, the third intersection 29*c* is an intersection of the third straight line 26*c* and a back surface of the boom body portion 11C, the second straight line 26*b* is a straight line orthogonal to the arm support shaft 43 and to the boom support shaft 35, and the third straight line 26*c* is a straight line orthogonal to the second straight line 26*b* and to the first cylinder support shaft 37 (the axis 37*a* of the first cylinder support shaft 37).

Since this also increases the bend angle 27 of the boom 11, it is possible to increase the height of the boom distal portion 11B when the boom is in the fully raised position 19 and also possible to reduce the weight of the boom 11.

When the boom 11 is in the fully raised position 19, a fifth distance 31*e* between a fifth intersection 29*e* and a sixth intersection 29*f* may be smaller than a sixth distance 31*f* between an axis 43*a* of the arm support shaft 43 and the fifth intersection 29*e*, where the fifth intersection 29*e* is an intersection of a fourth straight line 26*d* and a fifth straight line 26*e*, the sixth intersection 29*f* is an intersection of the fifth straight line 26*e* and a back surface of the boom body portion 11C, the fourth straight line 26*d* is a vertical line orthogonal to the arm support shaft 43, and the fifth straight line 26*e* is a straight line orthogonal to the fourth straight line 26*d* and to the first cylinder support shaft 37.

Since this also increases the bend angle 27 of the boom 11, it is possible to increase the height of the boom distal portion 11B when the boom is in the fully raised position 19 and also possible to reduce the weight of the boom 11.

When the boom 11 is in the fully raised position 19, a seventh distance 31*g* between the fourth straight line 26*d* and a seventh straight line 26*g* may be smaller than an eighth distance 31*h* between a sixth straight line 26*f* and the seventh straight line 26*g*, where the sixth straight line 26*f* is a vertical line orthogonal to the boom support shaft 35 (axis 35*a* of the boom support shaft 35) and the seventh straight line 26*g* is a vertical line orthogonal to the second cylinder support shaft 36 (axis 36*a* of the second cylinder support shaft 36).

Since this also increases the bend angle 27 of the boom 11, it is possible to increase the height of the boom distal portion 11B when the boom is in the fully raised position 19 and also possible to reduce the weight of the boom 11.

The sixth distance 31*f* may be larger than a ninth distance 31*i* which is a vertical distance between the fifth straight line 26*e* and an upper edge 11Ac of a side surface of the boom proximal portion 11A.

Since this also increases the bend angle 27 of the boom 11, it is possible to increase the height of the boom distal portion 11B when the boom is in the fully raised position 19 and also possible to reduce the weight of the boom 11.

The boom proximal portion 11A may include a pivotal support section 11Aa pivotally supported via the boom support shaft 35 and a connected section 11Ab connected to the first section 11Ca of the boom body portion 11C. The boom proximal portion 11A may be bent at a location between the pivotal support section 11Aa and the connected section 11Ab such that, when the boom 11 is in the fully raised position 19, the pivotal support section 11Aa extends in a diagonally rearward and upward direction from the boom support shaft 35 and the connected section 11Ab extends upward from the pivotal support section 11Aa.

With this, it is possible to sufficiently lower the boom 11 to a lowered position 25 in which the boom 11 is swung downward.

A bend angle (first bend angle) 27 between a front surface 11Ca1 of the first section 11Ca and a front surface 11Cb1 of the second section 11Cb may be larger than a bend angle (second bend angle) 39 between a front surface 11Aa1 of the pivotal support section 11Aa and a front surface 11Ab1 of the connected section 11Ab.

The working machine 1 may further include a working tool 13 pivotally supported on the arm 12 via a working tool support shaft 57 to swing about the working tool support shaft 57 between a working-tool crowd position Y1 and a working-tool dump position Y2, the working-tool crowd position Y1 being a position in in which a distal end portion 58 of the working tool is closest to the arm 12, the working-tool dump position Y2 being a position in which the distal end portion 58 of the working tool is most distant from the arm 12, an arm cylinder C3 to cause the arm 12 to swing in an arm crowd direction D1 toward the boom 11 and an arm dump direction D2 away from the boom 11, and an arm crowd restrictor 64 to limit a stroke S1 of the arm cylinder C3 in a direction that causes the arm 12 to move in the arm crowd direction D1 such that a swing path M3 of the distal end portion 58 of the working tool 13 and the boom cylinder C2 are separated from each other by a predetermined distance or more.

With this, it is possible, even when the bend angle 27 of the boom 11 is shallow, to avoid interference between the working tool 13 and the boom cylinder C2.

The working machine 1 may further include a working tool 13 pivotally supported on the arm 12 via a working tool support shaft 57 to swing about the working tool support shaft 57 between a working-tool crowd position Y1 and a working-tool dump position Y2, the working-tool crowd position Y1 being a position in which a distal end portion 58 of the working tool is closest to the arm 12, the working-tool dump position Y2 being a position in which the distal end portion 58 of the working tool is most distant from the arm 12, a working tool cylinder C4 to cause the working tool 13 to swing in a working-tool crowd direction D3 and a working-tool dump direction D4, the working-tool crowd direction D3 being a direction in which the distal end portion 58 of the working tool 13 approaches the working-tool crowd position Y1, the working-tool dump direction D4 being a direction in which the distal end portion 58 of the working tool 13 approaches the working-tool dump position Y2, and a working-tool crowd restrictor 66 to limit a stroke of the working tool cylinder C4 in a direction that causes the working tool 13 to move in the working-tool crowd direction D3 such that a swing path M3 of the distal end portion 58 of the working tool 13 and the boom cylinder C2 are separated from each other by a predetermined distance or more.

With this, it is possible, even when the bend angle 27 of the boom 11 is shallow, to avoid interference between the working tool 13 and the boom cylinder C2.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A single-arm working machine comprising:

a machine body;

one support bracket provided at a front portion of the machine body;

one boom support attached to the support bracket so as to be able to swing about a swing axis extending in an up-down direction;

one boom to swing upward and downward about a boom support shaft, the boom including a boom proximal portion pivotally supported on the boom support via the boom support shaft, a boom distal portion to pivotally support an arm via an arm support shaft such that the arm is swingable, and a boom body portion bent at an intermediate portion in a longitudinal direction of the boom, the boom body portion being a portion between the boom proximal portion and the boom distal portion; and a boom cylinder to extend and retract to cause the boom to swing, the boom cylinder being located on a front side of the boom and including a first end pivotally supported on a front side of the boom body portion via a first cylinder support shaft and a second end pivotally supported on the boom support via a second cylinder support shaft; wherein the boom is configured such that a bend angle does not change when the boom swings upward and downward about the boom support shaft, the bend angle being an angle between a front surface of a first section that is between the intermediate portion and the boom proximal portion, and a front surface of a second section that is between the intermediate portion and the boom distal portion; and the boom is further configured such that, when the boom is in a fully raised position thereof, a first straight line orthogonal to the arm support shaft and to the first cylinder support shaft and extending downward from the first cylinder support shaft passes rearward of a rear end of the boom support, and that the first section extends upward from the boom proximal portion toward the intermediate portion and the second section extends diagonally forward and upward from the intermediate portion, and that the first straight line passes forward of the machine body.

2. The single-arm working machine according to claim 1, further comprising:

an operator's seat mounted on the machine body; wherein the boom is configured such that a first extension line extending downward from a back surface of the second section passes forward of the operator's seat, the first extension line being an extension of the back surface of the second section when the boom is in the fully raised position.

3. The single-arm working machine according to claim 1, further comprising:

an operator's seat mounted on the machine body; wherein the boom is configured such that a second extension line extending downward from a front surface of the second section passes forward of the operator's seat, the second extension line being an extension of the front surface of the second section when the boom is in the fully raised position.

4. The single-arm working machine according to claim 1, wherein, when the boom is in the fully raised position, a first distance between a first intersection and a second intersection is smaller than a second distance between the second intersection and a third intersection, where the first intersection is an intersection of a second straight line and a third straight line, the second intersection is an intersection of the third straight line and a front surface of the boom body portion, the third intersection is an intersection of the third straight line and a back surface of the boom body portion, the second straight line is a straight line orthogonal to the arm support shaft and to the boom support shaft, and the third straight line is a straight line orthogonal to the second straight line and to the first cylinder support shaft.

5. The single-arm working machine according to claim 1, further comprising:

a working tool pivotally supported on the arm via a working tool support shaft to swing about the working tool support shaft between a working-tool crowd position and a working-tool dump position, the working-tool crowd position being a position in in which a distal end portion of the working tool is closest to the arm, the working-tool dump position being a position in which the distal end portion of the working tool is most distant from the arm;

an arm cylinder to cause the arm to swing in an arm crowd direction toward the boom and an arm dump direction away from the boom; and an arm crowd restrictor to limit a stroke of the arm cylinder in a direction that causes the arm to move in the arm crowd direction such that a swing path of the distal end portion of the working tool and the boom cylinder are separated from each other by a predetermined distance or more.

6. The single-arm working machine according to claim 1, further comprising:

a working tool pivotally supported on the arm via a working tool support shaft to swing about the working tool support shaft between a working-tool crowd position and a working-tool dump position, the working-tool crowd position being a position in which a distal end portion of the working tool is closest to the arm, the working-tool dump position being a position in which the distal end portion of the working tool is most distant from the arm;

a working tool cylinder to cause the working tool to swing in a working-tool crowd direction and a working-tool dump direction, the working-tool crowd direction being a direction in which the distal end portion of the working tool approaches the working-tool crowd position, the working-tool dump direction being a direction in which the distal end portion of the working tool approaches the working-tool dump position; and a working-tool crowd restrictor to limit a stroke of the working tool cylinder in a direction that causes the working tool to move in the working-tool crowd direction such that a swing path of the distal end portion of the working tool and the boom cylinder are separated from each other by a predetermined distance or more.

7. A working machine comprising:

a machine body;

a boom support located forward of the machine body;

a boom to swing upward and downward about a boom support shaft, the boom including a boom proximal portion pivotally supported on the boom support via the boom support shaft, a boom distal portion to pivotally support an arm via an arm support shaft such that the arm is swingable, and a boom body portion bent at an intermediate portion in a longitudinal direction of the boom, the boom body portion being a portion between the boom proximal portion and the boom distal portion; and a boom cylinder to extend and retract to cause the boom to swing, the boom cylinder being located on a front side of the boom and including a first end pivotally supported on a front side of the boom body portion via a first cylinder support shaft and a second end pivotally supported on the boom support via a second cylinder support shaft; wherein, the boom is configured such that, when the boom is in a fully raised position thereof, a first section between the intermediate portion and the boom proximal portion extends upward from the boom proximal portion toward the intermediate portion and a second section between the intermediate portion and the boom distal portion extends diagonally forward and upward from the intermediate portion, and that a first straight line orthogonal to the arm support shaft and to the first cylinder support shaft and extending downward from the first cylinder support shaft passes forward of the machine body, and when the boom is in the fully raised position, a fifth distance between a fifth intersection and a sixth intersection is smaller than a sixth distance between an axis of the arm support shaft and the fifth intersection, and where the fifth intersection is an intersection of a fourth straight line and a fifth straight line, the sixth intersection is an intersection of the fifth straight line and a back surface of the boom body portion, the fourth straight line is a vertical line orthogonal to the arm support shaft, and the fifth straight line is a straight line orthogonal to the fourth straight line and to the first cylinder support shaft.

8. The working machine according to claim 7, wherein, when the boom is in the fully raised position, a seventh distance between the fourth straight line and a seventh straight line is smaller than an eighth distance between a sixth straight line and the seventh straight line, where the sixth straight line is a vertical line orthogonal to the boom support shaft and the seventh straight line is a vertical line orthogonal to the second cylinder support shaft.

9. The working machine according to claim 7, wherein the sixth distance is larger than a ninth distance which is a vertical distance between the fifth straight line and an upper edge of a side surface of the boom proximal portion.

10. A working machine comprising:

a machine body;

a boom support located forward of the machine body;

a boom to swing upward and downward about a boom support shaft, the boom including a boom proximal portion pivotally supported on the boom support via the boom support shaft, a boom distal portion to pivotally support an arm via an arm support shaft such that the arm is swingable, and a boom body portion bent at an intermediate portion in a longitudinal direction of the boom, the boom body portion being a portion between the boom proximal portion and the boom distal portion; and a boom cylinder to extend and retract to cause the boom to swing, the boom cylinder being located on a front side of the boom and including a first end pivotally supported on a front side of the boom body portion via a first cylinder support shaft and a second end pivotally supported on the boom support via a second cylinder support shaft; wherein the boom is configured such that, when the boom is in a fully raised position thereof, a first section between the intermediate portion and the boom proximal portion extends upward from the boom proximal portion toward the intermediate portion and a second section between the intermediate portion and the boom distal portion extends diagonally forward and upward from the intermediate portion, and that a first straight line orthogonal to the arm support shaft and to the first cylinder support shaft and extending downward from the first cylinder support shaft passes forward of the machine body, and the boom proximal portion includes a pivotal support section pivotally supported via the boom support shaft and a connected section connected to the first section of the boom body portion, and the boom proximal portion is bent at a location between the pivotal support section and the connected section such that, when the boom is in the fully raised position, the pivotal support section extends in a diagonally rearward and upward direction from the boom support shaft and the connected section extends upward from the pivotal support section.

11. The working machine according to claim 10, wherein a first bend angle between a front surface of the first section and a front surface of the second section is larger than a second bend angle between a front surface of the pivotal support section and a front surface of the connected section.

* * * * *